US007327342B2

(12) United States Patent
Nose et al.

(10) Patent No.: US 7,327,342 B2
(45) Date of Patent: Feb. 5, 2008

(54) CONTROLLER/DRIVER FOR DRIVING DISPLAY PANEL

(75) Inventors: Takashi Nose, Kanagawa (JP); Junyou Sioda, Kanagawa (JP)

(73) Assignees: NEC Electronics Corporation, Kanagawa (JP); Bitboys Oy, Noormarkku (FI)

( * ) Notice: Subject to any disclaimer, the term of this patent is extended or adjusted under 35 U.S.C. 154(b) by 658 days.

(21) Appl. No.: 10/954,332

(22) Filed: Oct. 1, 2004

(65) Prior Publication Data

US 2005/0073526 A1 Apr. 7, 2005

(30) Foreign Application Priority Data

Oct. 2, 2003 (JP) ..... 2003-345005

(51) Int. Cl.
*G09G 3/36* (2006.01)

(52) U.S. Cl. ..... 345/98; 345/204

(58) Field of Classification Search ..... 345/87–100, 345/204

See application file for complete search history.

(56) References Cited

U.S. PATENT DOCUMENTS 6,806,859 B1 * 10/2004 Kanoh et al. ..... 345/98
6,825,826 B1 * 11/2004 Mikami et al. ..... 345/98

FOREIGN PATENT DOCUMENTS

JP 9-281950 10/1997

* cited by examiner

*Primary Examiner*—Richard Hjerpe
*Assistant Examiner*—Jean Lesperance
(74) *Attorney, Agent, or Firm*—Young & Thompson

(57) ABSTRACT

A controller is composed of a control section, first and second memory sections, and a driver section. The control section divides first bitmap image data representative of $n_1$ grayscale image into first and second data pieces, $n_1$ being a natural number. The first memory section stores first storage data selected out of the first data piece and second bitmap image data representative of $n_2$ grayscale image, $n_2$ being smaller than $n_1$. The second memory section stores second storage data selected out of the second data piece and the first storage data received from the first memory section. The driver section is configured to drive data lines of a display panel in response to the first and second storage data stored in the first and second memory sections, respectively.

20 Claims, 22 Drawing Sheets

CONTROLLER/DRIVER FOR DRIVING DISPLAY PANEL

BACKGROUND OF THE INVENTION

1. Field of the Invention

The present invention is related to controller/drivers for driving display panels, and methods of operating the same, more particularly, to controller/drivers including a display memory for storing display data representative of images to be displayed.

2. Description of the Related Art

Portable devices, including cell phones and PDAs (personal data assistant), are usually composed of a liquid crystal display (LCD) for user interface. Such portable devices typically use a controller/driver for driving the LCD. Typical controller/drivers drive an LCD in response to bitmap data received from a CPU provided within the mobile portable.

As disclosed in Japanese Open Laid Patent Application No. Jp-A-Heisei 9-281950, controller/drivers often include display memories for storing display data. Such controller/drivers temporarily store display data in the display memories; display data stored in the display memories are used for driving LCDs.

One of the recent user's requirements for portable devices is highly sophisticated display on the LCDs. Many users of portable devices desire displaying fine images with highly intense grayscale, and moving pictures with improved smoothness on the LCDs. Therefore, recent portable devices often include a high resolution LCD and a controller/driver adapted to display high grayscale images and smooth moving pictures.

One of the problems in providing highly sophisticated display is that an increased amount of display data is required to be transmitted to controller/drivers. Improving fineness and grayscale resolution of images, and smoothness of moving images is inevitably accompanied by considerable increase in the amount of image data to be transmitted to controller/drivers. The increase in the image data transmitted to controller/drivers undesirably increases power consumption of the controller/drivers, because controller/drivers consume power for receiving data bits of image data. Increase in the power consumption is quite significant, especially for portable devices. Additionally, the increase in the image data transmitted to controller/drivers undesirably leads to increased EMI (Electromagnetic interference), because controller/drivers emit EMI when receiving data bits of image data.

The inventors have discovered that a controller/driver architecture in which images are partially transmitted by using a vector form, not by the bitmap form, is preferable for satisfying the users' requirements. From the inventors' recognitions, the bitmap form is suitable for representing some images displayed on portable devices, and vector forms are suitable for representing other images. Photograph images, which require many graylevels for achieving rich representations, such as fine gradation, are suitable for being represented in the bitmap form. On the other hand, images mainly represented by contrast, such as video game images and map images, are not suitable for the bitmap form, because the use of the bitmap form unnecessarily increases the data size. Additionally, representing moving pictures by image data in the bitmap form undesirably necessitates increased data transfer. The inventors consider that the bitmap form should be used for transferring images which require rich representations, such as photograph images, and another form, including a vector form, should be used for transferring images which require reduced data transfer, such as video game images and map images. This technique, which is not in the public domain to the inventors' knowledge, would be effective for reducing data transfer to controller/drivers with improved image qualities.

One of the issues for making this technique commercially available is size reduction of the circuitries incorporated within the controller/drivers. In general, data line drivers within controller/drivers are only adapted to bitmap images. Therefore, the use of a form other than the bitmap form necessitates incorporating a circuit converting the image data in the other form to the bitmap data into the controller/drivers; however, this undesirably increases the cost of the controller/drivers.

Therefore, there is a need for providing controller/drivers adapted to the bitmap form and another form with reduced circuit size.

SUMMARY OF THE INVENTION

In an aspect of the present invention, a controller/driver is composed of a control section, first and second memory sections, and a driver section. The control section divides first bitmap image data representative of $n_1$ grayscale image into first and second data pieces, $n_1$ being a natural number. The first memory section stores first storage data selected out of the first data piece and second bitmap image data representative of $n_2$ grayscale image, $n_2$ being smaller than $n_1$. The second memory section stores second storage data selected out of the second data piece and the first storage data received from the first memory section. The driver section is configured to drive data lines of a display panel in response to the first and second storage data stored in the first and second memory sections, respectively. The second data piece is selected as the second storage data to be stored in the second memory section, when the first data piece is selected as the first stored data to be stored in the first memory section. The first storage data is selected as the second storage data to be stored in the second memory section, when the second bitmap image data is selected as the first stored data.

The controller/driver thus constructed is suitable for treating both of image data represented in a bitmap form and image data represented in another form. The controller/driver is adapted to both of image data represented in a bitmap form and image data represented in another form, by being provided with an image processor configured to generate second bitmap image data through processing third image data represented in a form other than the bitmap form using said first memory section as a work area. In the controller/driver thus constructed, the first memory section is used as both of a work area for performing data processing of the third image data, as well as a storage area for storing the first data piece. Additionally, the second memory section is used both for storing the second bitmap data and for storing the second data piece. Therefore, this architecture effectively allows the controller/driver to deal with image data represented in a bitmap form and image data represented in another form with a reduced memory size.

DESCRIPTION OF THE PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposes.

First Embodiment

1. System Structure

Figure 1:
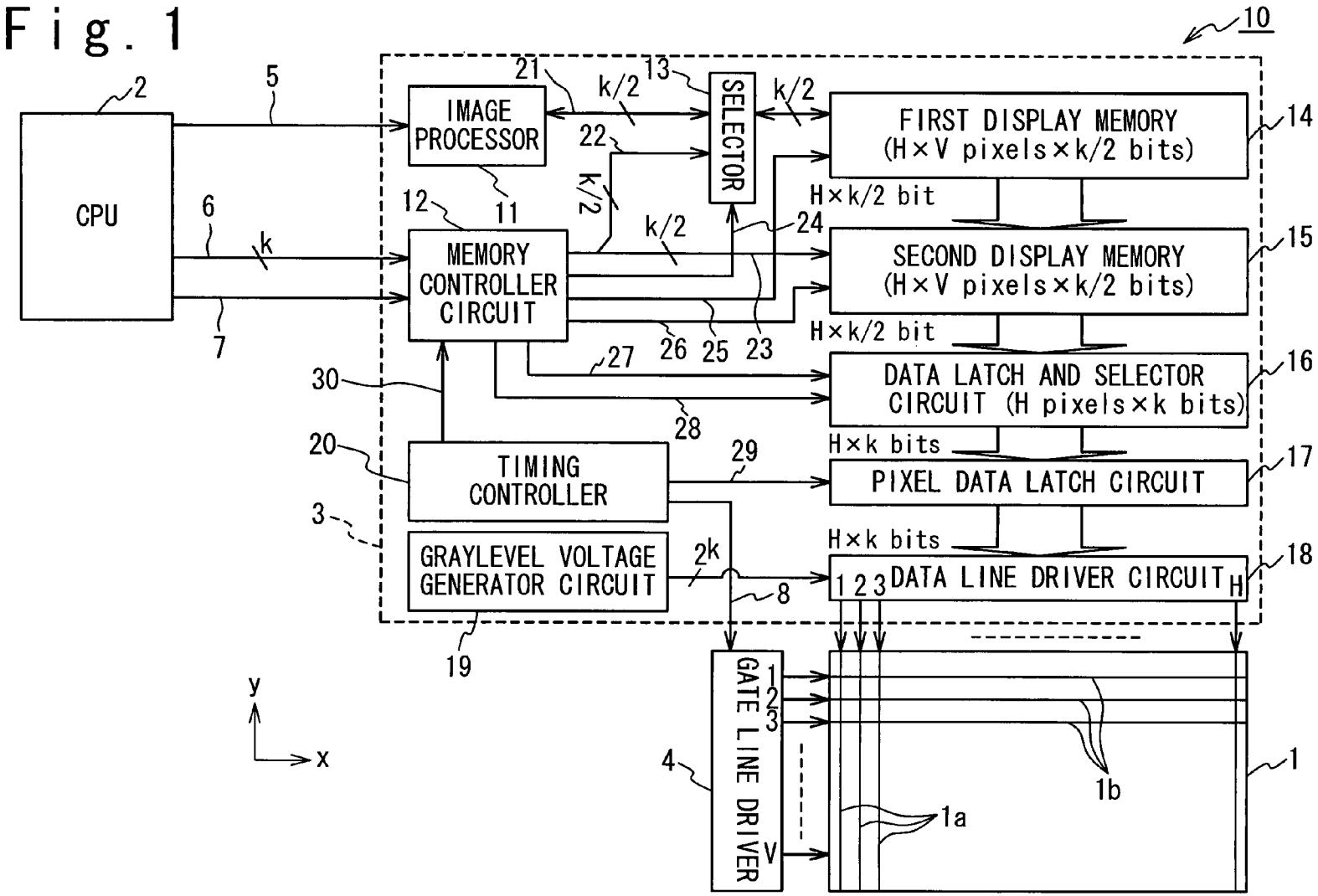
FIG. 1 is a block diagram illustrating an exemplary structure of a controller/driver in accordance with a first embodiment of the present invention.

In a first embodiment, as illustrated in FIG. 1, a display device 10 is composed of an LCD 1, a CPU 2, a controller/driver 3, and a gate line driver 4.

The LCD 1 includes H data lines (source lines) 1*a*, and V gate lines 1*b*, which intersect each other. The data lines 1*a* extend in a y-axis direction (vertical direction), while the gate lines 1*b* extend in an x-axis direction (horizontal direction). Pixels are disposed at the intersections of the data lines 1*a* and the gate lines 1*b*; in other words, the LCD 1 includes pixels arranged in H lines and V columns. Pixels which are connected to the same gate line 1*b* may be collectively referred to as "a line of pixels".

The CPU 2 develops image data representative of images to be displayed on the LCD 1, and provides the developed image data for the controller/driver 3. The image data transferred from the CPU 2 to the controller/driver 3 are developed in one of the two forms: one is the bitmap form, and another is a vector form.

In the case when the developed image is suitable for the vector data, for example, when the image is representable by reduced graylevels, the CPU 2 generates vector data 5 representing the image to output the controller/driver 3. The vector data 5 is composed of vector graphic commands (which may be simply referred to as command hereinafter), each representative of a graphic primitive included in the image; an image frame is represented by one or more commands. The vector data 5 may be described in the SVG™ (Scalable Vector Graphic) form, or the MacromediaFlash™ form. The use of the vector form allows an image to be represented with reduced data compared to the bitmap form, and thereby effectively reduces data transfer from the CPU 2 to the controller/driver 3.

In the case when the image developed by the CPU 2 is suitable for being represented in the bitmap form, for example, when the developed image is a photograph image represented by many graylevels, the CPU 2 develops bitmap data 6 associated with the image to output to the controller/drivers. The bitmap data 6 is k-bit bitmap data, which is adapted to $2^k$ grayscale images, while the aforementioned vector data 5 is image data adapted to $2^{k/2}$ grayscale images.

Additionally, the CPU 2 controls the controller/driver 3 through providing memory control signals 7, including a data mode signal indicating that which form is used for developing the image data by the CPU 2.

The controller/driver 3 drives the data lines 1*a* of the LCD 1 in response to the vector data 5, the bitmap data 6, and the memory control signals 7, which are received from the CPU 2. The controller/driver 3 is configured to be adapted to both of the vector data 5, and the bitmap data 6. When receiving the vector data 5, the controller/driver 3 converts the vector data 5 into bitmap data, and drives the LCD 1 using the bitmap data developed from the vector data 5. When receiving the bitmap data 6, on the other hand, the controller/driver 3 drives the LCD 1 in response to the bitmap data 6.

Additionally, the controller/driver 3 generates a control signal 8 for controlling the gate line driver 4.

The gate line driver 4 drives the gate lines 1*b* of the LCD 1 in response to the control signal 8 received from the controller/driver 3.

2. Structure of Controller/Driver

The controller/driver 3 is composed of an image processor 11, a memory controller circuit 12, a selector 13, a first display memory 14, a second display memory 15, a data latch and selector circuit 16, and a pixel data latch circuit 17, a data driver circuit 18, a grayscale voltage generator circuit 19, and a timing controller 20.

The image processor 11 converts the vector data 5 into bitmap data, and develops the bitmap data onto the first display memory 14. The image processor 11 uses the first display memory 14 as the work area for developing the bitmap data. In details, the image processor 11 sequentially interprets the commands within the vector data 5 to develop intermediate work data 21 representative of the graphic primitives associated with the commands, and sequentially writes the developed intermediate work data 21 into the first display memory 14. It should be noted that the intermediate work data 21 is described in the bitmap form. When a graphic primitive associated with newly developed one of the intermediate work data 21 overlaps another graphic primitive already existing in the first display memory 14, the image processor 11 overwrites the associated portion of the first display memory 14. After completing interpretation of the commands associated with an image frame, bitmap data representing the image frame is developed onto the first display memory 14.

The memory controller circuit 12 is designed to transfer the bitmap data 6 received from the CPU 2 to the first and second display memories 14 and 15, and to control the selector 13, the first and second memories 14 and 15, and the data latch and selector circuit 16. In detail, the memory controller circuit 12 provides functions listed below:

(1) a function of dividing the bitmap data 6 into lower and upper bit data 22 and 23, the lower bit data 22 being the lower k/2 bits of the bitmap data 6, and the upper bit data 23 being the upper k/2 bits of the bitmap data 6;

(2) a function of providing a data select signal 24 for the selector 13;

(3) a function of controlling the first and second display memories 14, and 15 through providing first and second memory control signals 25 and 26 for the first and second display memories 14, and 15, respectively; and (4) a function of providing first and second latch signals 27 and 28 for the data latch selector circuit 16.

The selector 13 is responsive to the data select signal 24 received from the memory controller circuit 12 to select one of the intermediate work data 21 and the lower bit data 23. The selector 13 provides the selected data for the first display memory 14.

The first display memory 14 stores therein the image data received from the selector 13. The first display memory 14 has a capacity of H×V×k/2 bits. This implies that the first display memory 14 has a capacity sufficient to store the image data necessary for $2^{k/2}$ grayscale display of one image frame, in other words, sufficient to store half of the image data necessary for $2^k$ grayscale display of one image frame. The first display memory 14 outputs the data stored therein to the second display memory 15 in response to the first memory control signal 25 received from the memory control circuit 12. The first display memory 14 is designed to output H×(k/2) data bits in parallel.

The second display memory 15 is responsive to the second memory control signal 26 for storing the data received from the first display memory 14, or storing the upper bit data 23 received from the memory control circuit 12. As is the case of the first display memory 14, the second display memory 15 has a capacity of H×V×k/2 bits. The second display memory 15 outputs the data stored therein to the data latch and selector circuit 16 in response to the second memory control signal 26 received from the memory control circuit 12. The second display memory 15 is designed to output H×(k/2) data bits in parallel. Additionally, as described later in detail, the second display memory 15 is design to transfer the data stored in the first display memory 14 to the data latch and selector circuit 16 without damaging the data stored in the second display memory 15. This eliminates a need for providing dedicated interconnections for transferring the data from the first display memory 14 to the data latch and selector circuit 16, and effectively reduces the chip size of the controller/driver 3.

The data latch and selector circuit 16, the pixel data latch circuit 17, the data line driver circuit 18, and the grayscale voltage generator circuit 19 function as a drive circuitry for driving the LCD 1 in response to the data stored in the first and second display memories 14 and 15.

Figure 2:
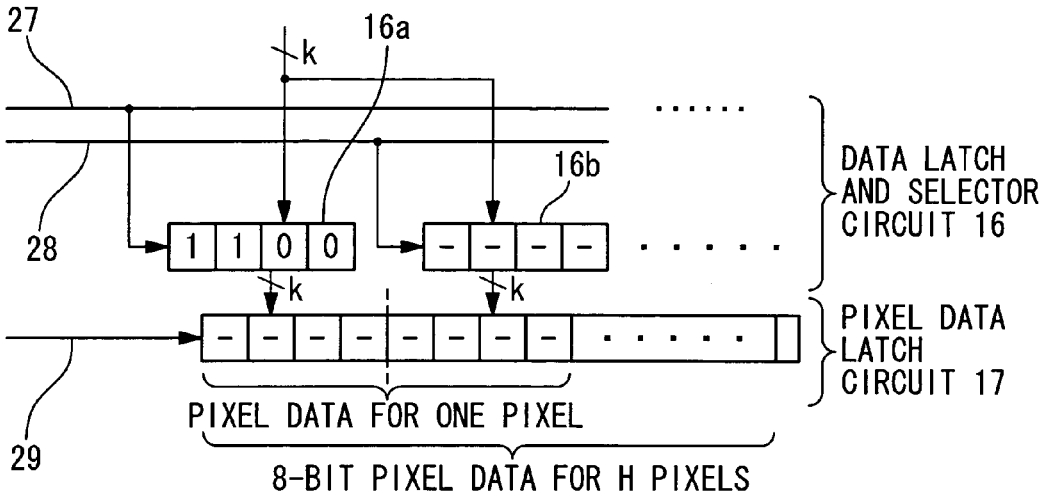
FIG. 2 is a block diagram illustrating exemplary structures of a data latch and selector circuit and a pixel data latch circuit within the controller/driver in accordance with the first embodiment.

The data latch and selector circuit 16 latches the data received from the second display memory 15 in response to the first and second latch signals 27 and 28. As shown in FIG. 2, the data latch and selector circuit 15 includes H first latch circuits 16*a* and H second latch circuits 16*b* (each one shown), H being the number of the data lines 1*a*. Each of latch circuits 16*a* and 16*b* is configured to latch k/2 data bits in parallel. Both of the latch circuits 16*a* and 16*b* are connected to the connected to the second display memory 15; each latch circuit 16*a* shares the input with the associated latch circuit 16*b*. It should be noted, however, that the first and second latch circuits 16*a* and 16*b* are operated independently. In response to the first latch signal 27 being activated, that is, in response to the first latch signal 27 being set high, the first latch circuits 16*a* latch the data received from the second display memory 15. Correspondingly, in response to the second latch signal 28 being activated, the second first latch circuits 16*b* latch the data received from the second display memory 15.

It should be noted that the data received from the second display memory 15 include the data transferred from the first display memory 14 through the second display memory 15. As described later, the first latch circuits 16*a* are only used for latching the data stored in the first display memory 15, while the second latch circuits 16*b* are used for latching the data stored in both of the first and second display memories 15 and 16.

A set of data outputted from one of the first latch circuit 16*a* and the associated one of the second latch circuit 16*b* constitute pixel data for the associated pixel. The data outputted from the first latch circuits 16*a* are used as the upper k/2 bits of the pixel data, and those from the second latch circuits 16*b* are used as the lower k/2 bits of the pixel data.

The pixel data latch circuit 17 is responsive to the latch signal 29 from the timing controller 20 to latch the pixel data received from the data latch and selector 16. The pixel data latch circuit 17 transfers the data latched therein to the data line driver circuit 18.

The data line driver circuit 18 and the grayscale voltage generator circuit 19 are used for drive the data lines 1*a* in response to the pixel data. Specifically, the grayscale voltage generator circuit 19 is designed to provide the data line driver circuit 19 with $2^k$ voltages, each associated with the $2^k$ graylevels allowed for the LCD 1. The data line driver circuit 18 selects the voltages in response to the pixel data, and develops the selected voltages onto the associated data lines 1*a* of the LCD 1. The outputs of the data line driver circuit 18, through which the selected voltages are outputted, are arranged in a line in the x-axis direction.

The timing controller 20 is used for timing control of the circuits within the controller/driver 3 and the gate line driver 4. Specifically, the timing controller 20 outputs a timing control signal 30 to the memory controller circuit 12, and thereby controls the write/read timings of the first and second display memories 14 and 15, and also controls the data latch timing of the data latch and selector circuit 16. Additionally, the timing controller 20 provides the latch signal 29 for the pixel data latch circuit 17 to control the data latch timing of the pixel data latch circuit 17. Furthermore, the timing controller 20 provides the control signal 8 for the gate line driver 4 to control the timing when the gate line driver 4 drives the gate lines 1*b* of the LCD 1.

Figure 3:
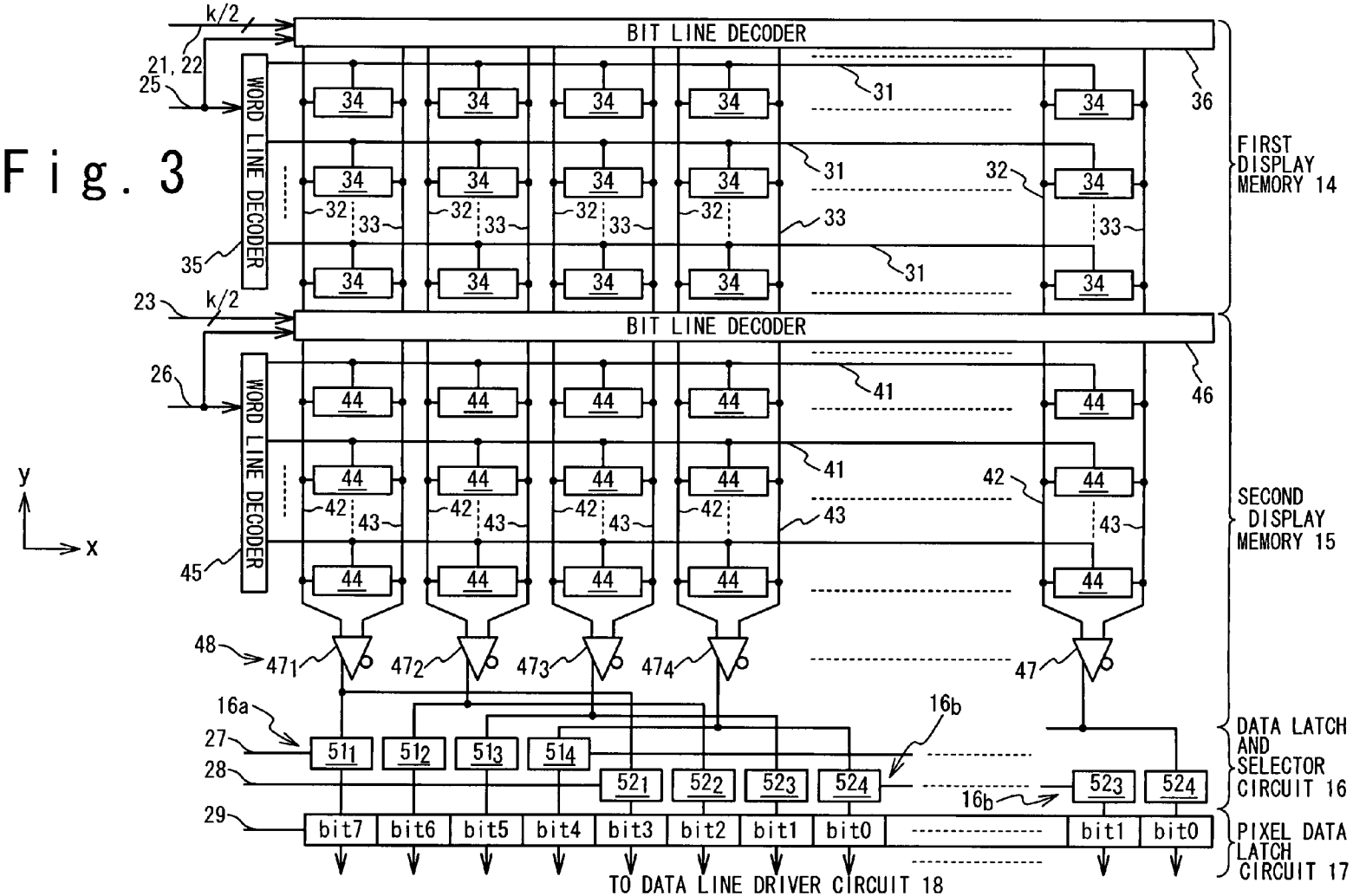
FIG. 3 is a block diagram illustrating exemplary structures of first and second display memories in accordance with the first embodiment.

FIG. 3 illustrates detailed circuit topologies of the first and second display memories 14, and 15, the data latch and selector circuit 16, and the pixel data latch circuit 17.

The first display memory 15 is composed of word lines 31, bit lines 32, complementary bit lines 33, memory cells 34, a word line decoder 35, and a bit line decoder 36. The number of the word lines 31 is V, which is identical to the number of the gate lines 1*b*. The number of the bit lines 32 and the complementary bit lines 33 is H×(k/2), H being the number of the data lines 1*a*. Finally, the number of the memory cells 34 is H×V×(k/2). The word lines 31 are disposed to extend in the x-axis direction, and the bit lines 32 are disposed to extend in the y-axis direction. The complementary bit lines 33 are respectively associated with the bit lines 32; the voltage of each complementary bit line 33 is complementary to the associated bit line 32. One bit line 32 and the associated bit line 33 are collectively referred to as a bit line pair. The memory cells 34 are arranged at the respective intersections of the word lines 31 and the bit lines 32. Each memory cell 34 is connected to the associated word line 31, bit line 32, and complementary bit line 33. The word line decoder 35 is used for selecting the word lines 31 in response to the memory control signal 25. The bit line decoder 36 is used for data access through the bit lines 32 and the complementary bit lines 33; the bit line decoder 36 develops voltages corresponding to the data received from the selector 13 on the associated bit lines 32 and complementary bit lines 33. The data received from the selector 13 may be the intermediate work data 21 or the lower bit data 22.

The data transfer from the first display memory 14 to the second display memory 15 is achieved through directly connecting the bit lines 32 and the complementary bit lines 33 with the second display memory 15. In an alternative embodiment, the bit lines 32 and the complementary bit lines 33 may be connected with a sense amplifier, and the sense amplifier may be used for data transfer from the first display memory 14 to the second display memory 15.

The structure of the second display memory 15 is almost identical to that of the first display memory 14 with exception that the second display memory 15 additionally includes sense amplifiers. More specifically, the second display memory 15 is composed of word lines 41, bit lines 42, complementary bit lines 43, memory cells 44, a word line decoder 45, a bit line decoder 46, and sense amplifiers 47. The number of the word lines 41 is V, and the number of the bit lines 33 and the complementary bit lines 34 is H×(k/2). Additionally, the number of the memory cells 34 is H×V×(k/2), and the number of the sense amplifiers 47 is H×(k/2). The word lines 41 are disposed to extend in the x-axis direction, and the bit lines 42 are disposed to extend in the y-axis direction. The complementary bit lines 43 are respectively associated with the bit lines 42; the voltage of each complementary bit line 43 is complementary to the associated bit line 42. One bit line 42 and the associated bit line 43 are collectively referred to as a bit line pair. The memory cells 44 are arranged at the respective intersections of the word lines 41 and the bit lines 42. Each memory cell 44 is connected to the associated word line 41, bit line 42, and complementary bit line 43. The word line decoder 45 is used for selecting the word lines 41 in response to the memory control signal 26. The bit line decoder 46 is used for data access through the bit lines 42 and the complementary bit lines 43; the bit line decoder 46 connects the bit lines 32 and complementary bit lines 33 of the first display memory 14 with the associated bit lines 42 and complementary bit lines 43 of the second display memory 15. Additionally, the bit line decoder 46 receives the upper bit data 23 in response to the memory control signal 26, and develops voltages corresponding to the upper bit data 23 on the associated bit lines 42 and complementary bit lines 43. The sense amplifiers 47 are respectively associated with the bit line pairs. The sense amplifiers 47 compares the voltages developed on the associated bit lines 42 and complementary bit lines 43 to identify the data developed on the associated bit lines 42. The H×(k/2) sense amplifiers 47 are grouped into H sense amplifier sets 48, each including (k/2) sense amplifiers 47. The (k/2) sense amplifiers 47 associated with a specific sense amplifier set 48 may be identified by an index attached therewith.

The memory architecture in which the number of the bit lines within the first display memory 14 is identical to that of the second display memory 15 is effective for facilitating the data transfer from the first display memory 14 to the second display memory 15. Such memory architecture allows one-to-one connection between the bit lines 32 within the first display memory 14, and the bit lines 42 within the second display memory 15. The same goes for the complementary bit lines 33 and 43. This effectively simplifies the circuits used for transferring the image data. Additionally, the aforementioned memory architecture allows the memory controller circuit 12 to use the same address to identify the location of the data source and destination of the image data. This effectively simplifies address generation.

The first and second latch circuits 16*a* and 16*b* within the data latch and selector circuit 16 are one-to-one associated with the sense amplifier sets 48. Each first latch circuit 16*a* is composed of k/2 one-bit latches $51_1$ to $51_{k/2}$, and each second latch circuit 16*b* is composed of k/2 one-bit latches $52_1$ to $52_{k/2}$. The latch $51_1$ and $52_1$ are connected to the output of the sense amplifier $47_1$ of the sense amplifier set 48 associated with the associated first and second latch circuits 16*a* and 16*b*, and the latch $51_2$ and $52_2$ are connected to the output of the sense amplifiers $47_2$. Correspondingly, the latch $51_3$ and $52_3$ are connected to the sense amplifier $47_3$, and the latch $51_4$ and $52_4$ are connected to the sense amplifier $47_4$. The latches $51_1$ to $51_{k/2}$ within the first latch circuit 16*a* are used for storing the upper k/2 bits of the pixel data, while the latches 52, to $52_{k/2}$ within the second latch circuit 16*b* are used for the lower k/2 bits of the pixel data.

The pixel data latch circuit 17 is composed of one-bit latches arranged in a line. The latches used for storing the upper k/2 bit of the pixel data are connected to the latches 51 within the first latch circuit 16*a*, while those used for storing the lower k/2 bit of the pixel data are connected to the latches 52 within the second latch circuit 16*b*.

3. Operation of Controller/Driver

The operation of the controller/driver 3 in this embodiment will be described in detail. It should be noted that k, which is the number of the data bits for each pixel, is assumed to be eight. Additionally, a line of the pixels associated with the selected gate line is referred to as the pixels of the selected line.

(1) LCD Drive in Response to Bitmap Data

When receiving the bitmap data 6 from the CPU 2, the controller/driver 3 drives the LCD 1 in response to the bitmap data 6. In this case, the image processor circuit 11 is deactivated. The LCD drive in response to the bitmap data 6 involves the following Steps S01 and S02.

Step S01: Write Operation of the Bitmap Data 6

Figure 4:
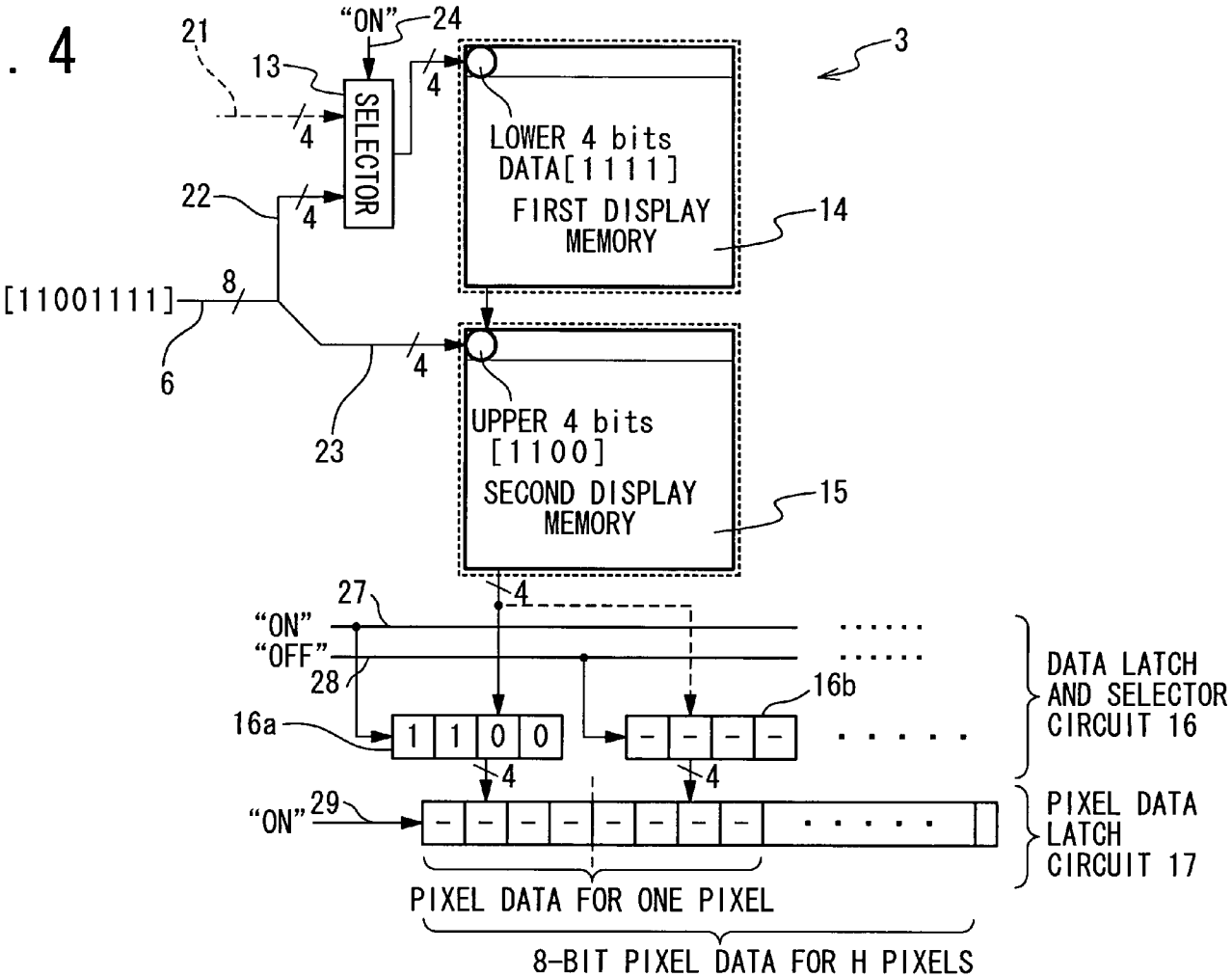
FIGS. 4 to 9 are block diagrams schematically illustrating an exemplary operation of the controller/driver in accordance with the first embodiment.

The bitmap data 6 is dividedly stored in the first and second display memories 14 and 15. Referring to FIG. 4, the CPU 2 informs the memory controller circuit 12 using the memory control signal 7 that the bitmap data 6 is provided for the controller/driver 3. In response to this information, the memory controller circuit 12 divides the bitmap data 6 into the lower and upper bit data 22 and 23. The memory controller circuit 12 then outputs the lower bit data 22 to the selector 13, and the upper bit data 23 to the second display memory 15. Additionally, the memory controller circuit 12 deactivates the data select signal 24 in response to the memory control signal 7. In FIG. 4 (and the following figures), the symbols "ON" in the drawings represent the activation of the associated signals, while the symbols "OFF" represent the deactivation of the associated signals. In response to the deactivation of the data select signal 24, the selector 13 selects the lower bit data 22 to output to the first display memory 14. The first display memory 14 stores therein the lower bit data 22, while the second display memory 15 stores therein the upper bit data 23. For example, when a graylevel of a specific pixel is represented by "11001111" in the bitmap data 6, "1111" is stored in the first display memory 14 and "1100" is stored in the second display memory 15.

Step S02: LCD Drive

Next, the bitmap data 6, dividedly stored in the first and second display memories 14 and 15 is transferred to the data line driver circuit 18 through the data latch and select circuit 16 and the pixel data latch circuit 17, and the LCD 1 is driven in response to the transferred bitmap data 6. Pixel data transfer from the first and second display memories 14 and 15 to the data line driver circuit 18 is achieved as described in the following.

Figure 5:
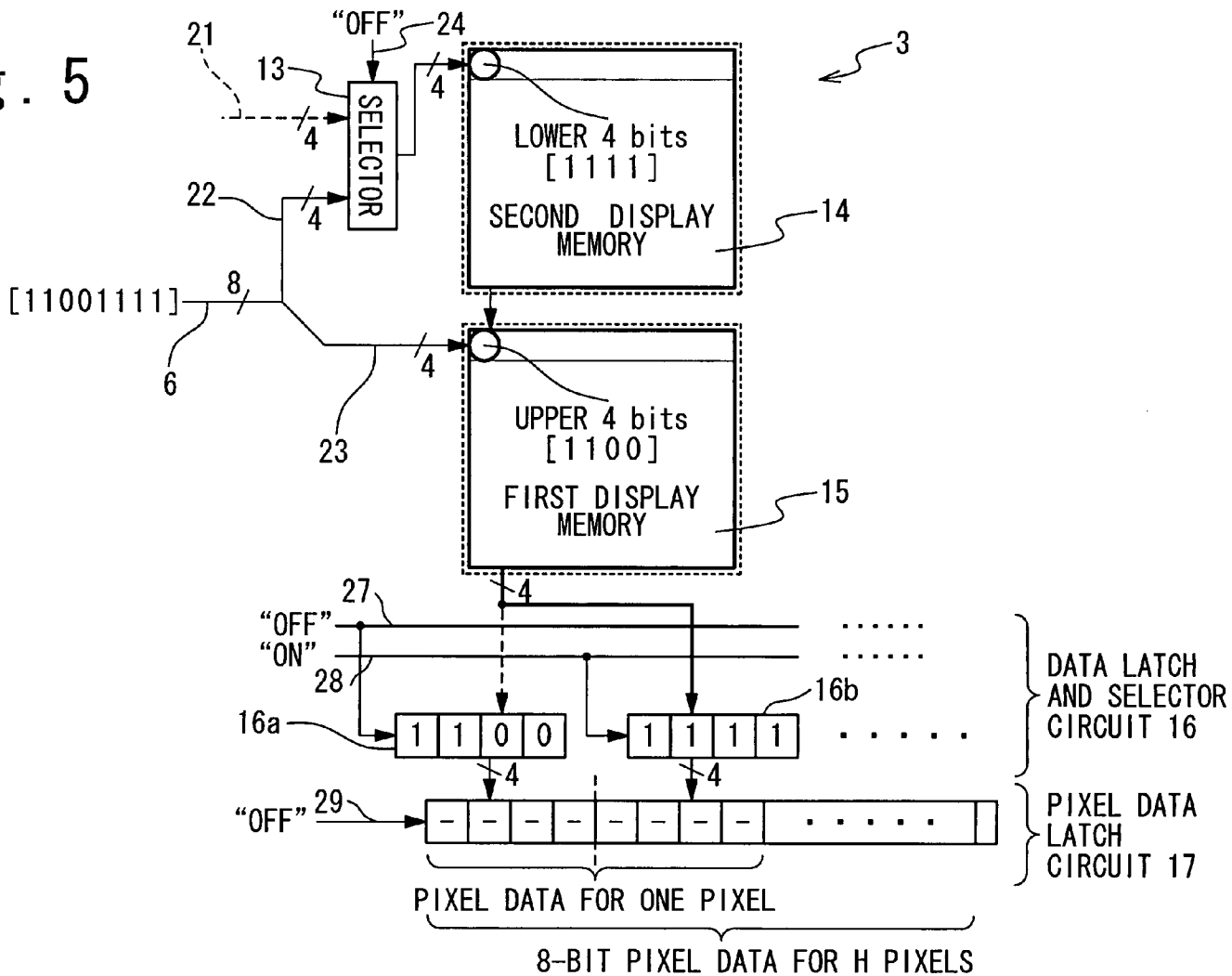
Figure 6:
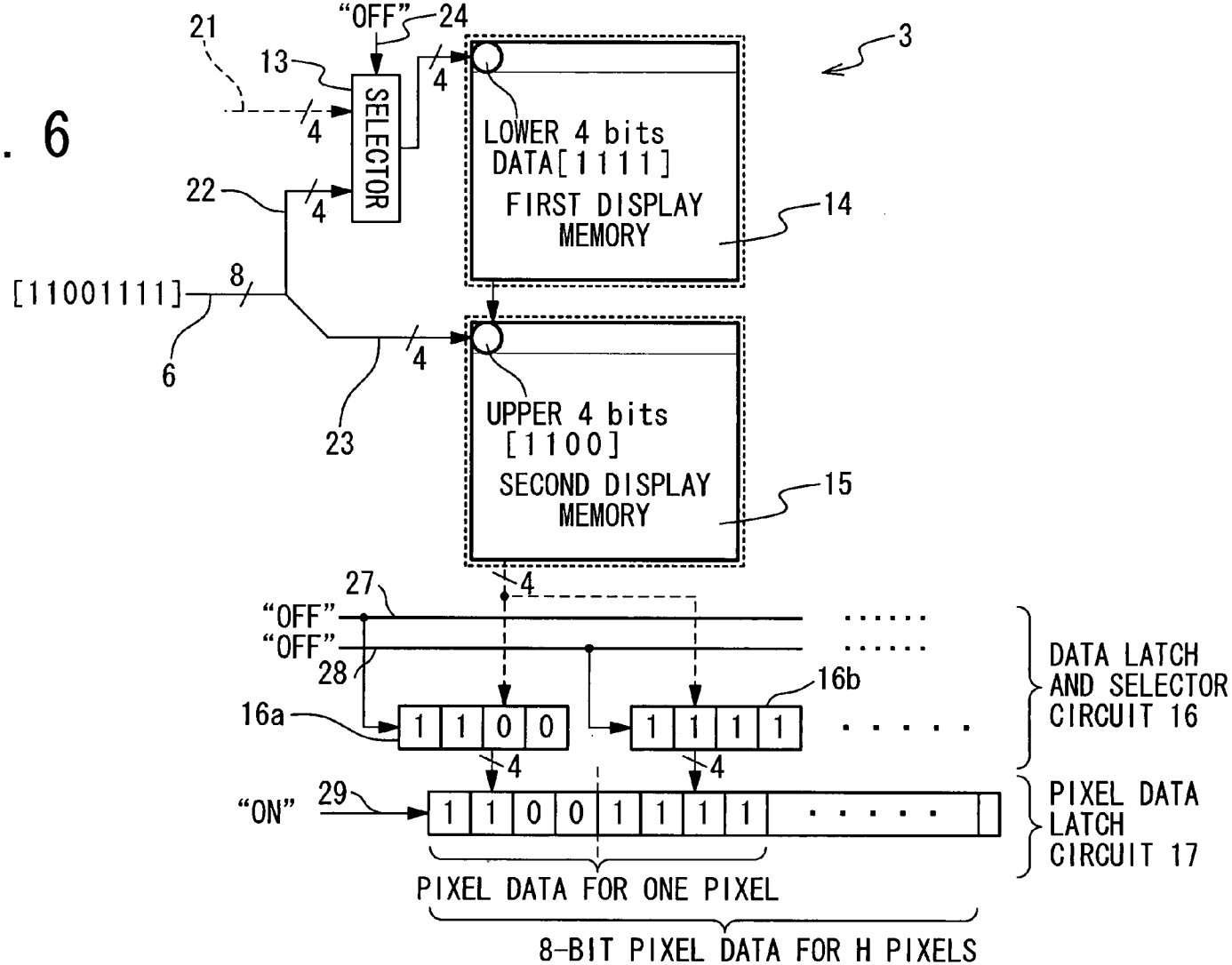

Firstly, pixel data associated with the pixels of the selected line are retrieved from the first and second display memories 14 and 15, and then transferred to the pixel data latch circuit 17 through the data latch and select circuit 16. Specifically, the first latch signal 27 is activated, and the second latch signal 28 is deactivated. This allows the first latch circuit 16*a* to latch the associated portion of the upper bit data 23 for the pixels of the selected line from the second display memory 15. This is followed by deactivating the first latch signal 27 and activating the second latch signal 28, as shown in FIG. 5. The associated portion of the lower bit data 22 is then transferred from the first display memory 14 to the second latch circuit 16*b*, for the pixels of the selected line. In detail, the lower bit data 22 stored in the first display memory 14 is transferred through the bit lines 42 (and complementary bit lines 43) to the sense amplifiers 47, and then outputted to the second latch circuit 16*b*. As shown in FIG. 6, the latch signal 29 is then activated. This allows the data stored in the first and second latch circuits 16*a* and 16*b* to incorporate each other to develop the pixel data associated with the pixels of the selected line onto the pixel data latch circuit 17. The upper four bits of the pixel data are the data bits received from the latch circuit 16*a*, and the lower four bits of the pixel data are the data bits received from the latch circuit 16*b*.

The data line driver circuit 18 then receives the pixel data from the pixel data latch circuit 17 to drive the data lines 1*a* to the voltages corresponding to the received pixel data. More specifically, the data line driver circuit 18 selects one voltage corresponding to the pixel data for each pixels of the selected line out of the $2^k$ voltages received from the grayscale voltage generator circuit 19. The data line driver circuit 18 then drives each data line 1*a* to the selected voltage.

In the meantime, the selected gate line 1*b* is activated by the gate line driver 4. This allows the pixels of the selected line to be set to the desired graylevels on.

The same operation is repeated scanning the gate lines 1*b*. The pixel data associated with the selected gate line 1*b* is retrieved from the first and second display memory 14 and 15, and the data lines 1*a* of the LCD 1 are driven in response to the retrieved data. Completely scanning the gate lines 1*b* achieves displaying one frame image.

(2) LCD Drive in Response to Vector Data

When receiving the vector data 5 from the CPU 2, the controller/driver 3 drives the LCD 1 in response to the vector data 5. The vector data 5 is firstly converted into bitmap data by the image processor circuit 11, and the LCD 1 is driven in response to the bitmap data obtained from the vector data 5. The LCD drive in response to the vector data 5 involves the following Steps S03 to S05.

Step S03: Vector Data Conversion

Figure 7:
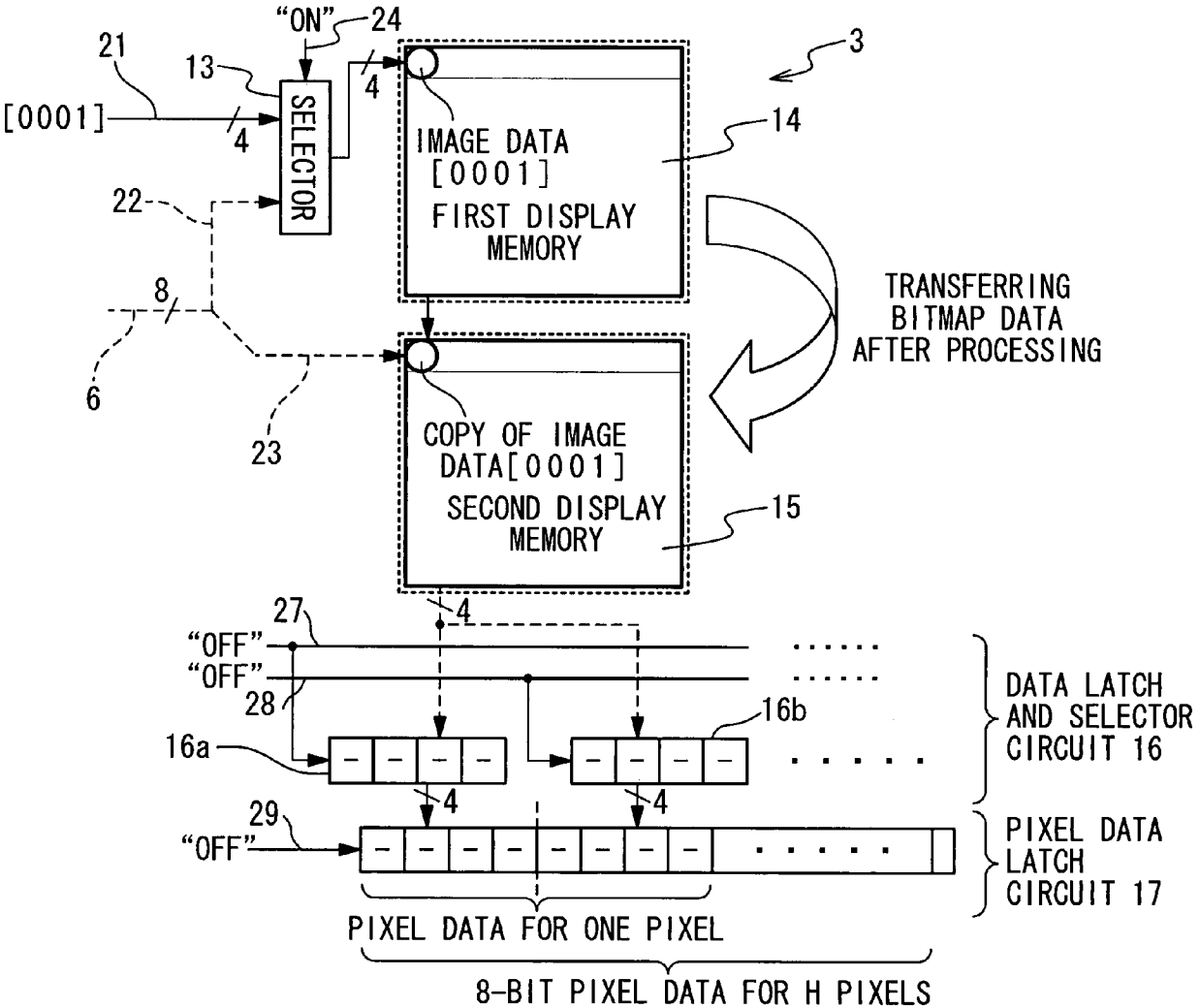

Data-conversion of the vector data 5 is firstly implemented to develop the corresponding bitmap data onto the first display memory 14. More specifically, the CPU 2 informs the memory controller circuit 12 using the memory control signal 7 that the vector data 5 is provided for the controller/driver 3. In response to the memory control signal 7, as shown in FIG. 7, the memory controller circuit 12 activates the data select signal 24. In response to the activation of the data select signal 24, the selector 13 selects the intermediate work data 21 to output the first display memory 14. In the meantime, the image processor 11 sequentially interprets the commands described in the vector data 5 to identify the graphic primitives to be incorporated in the display image, and develops the intermediate work data 21 corresponding to the graphic primitives in the bitmap form. The developed intermediate work data 21 is stored into the first display memory 14. When a graphic primitive associated with newly developed one of the intermediate work data 21 overlaps another graphic primitive already existing in the first display memory 14, the image processor 11 overwrites the associated portion of the first display memory 14. After completing interpretation of the commands associated with an image frame, bitmap data representing the image frame is developed onto the first display memory 14. The bitmap data developed onto the first display memory 14 is four-bit bitmap data, representative of $2^4$ graylevels.

Step S04: Bitmap Data Transfer

As shown in FIG. 7, the bitmap data developed onto the first display memory 14 is then transferred to the second display memory 15.

As described later, the LCD 1 is driven in response to the bitmap data stored in the second display memory 15; the bitmap data developed onto the first display memory 14 is not directly used for driving the LCD 1. This addresses avoiding an "incomplete" image being displayed on the LCD 1. It is not until the complete set of the commands associated with the target image frame are processed by the image processor 11 that an "complete" bitmap data is developed onto the first display memory 14; however, the development of the "complete" bitmap data onto the first display memory 14 may fail to be synchronized with the update or refreshing timings of the images displayed on the LCD 1. Therefore, directly using the bitmap data stored in the first display memory 14, which is used as the work area, may cause an undesirable image to be displayed on the LCD 1. In order to avoid an undesirable image to be displayed, after developing a "complete" bitmap data, the "complete" bitmap data is transferred from the first display memory 14 to the second display memory 15. The bitmap data stored in the second display memory 15 is exclusively used for updating or refreshing the images on the LCD 1.

Step S05: LCD Drive

Figure 8:
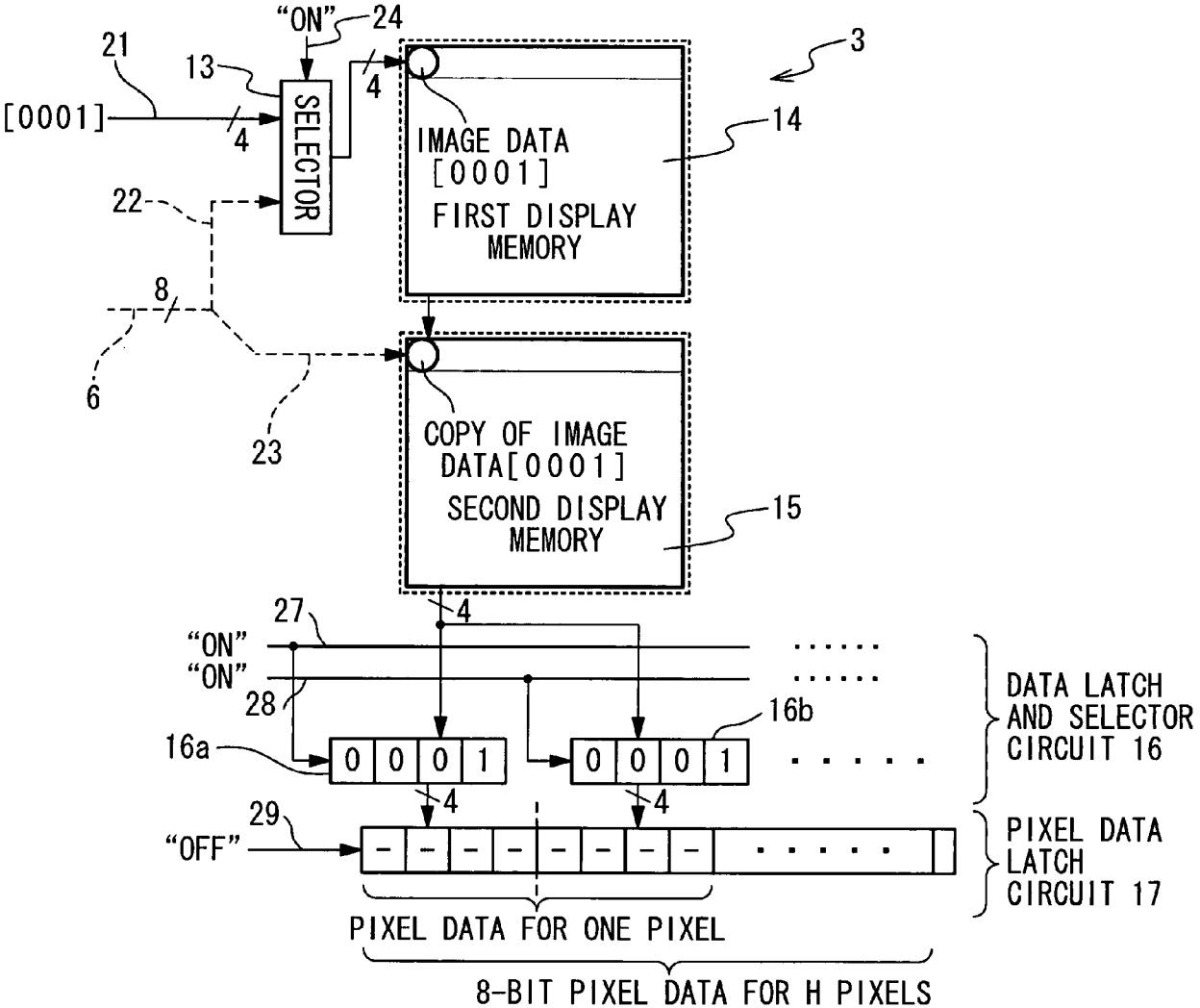
Figure 9:
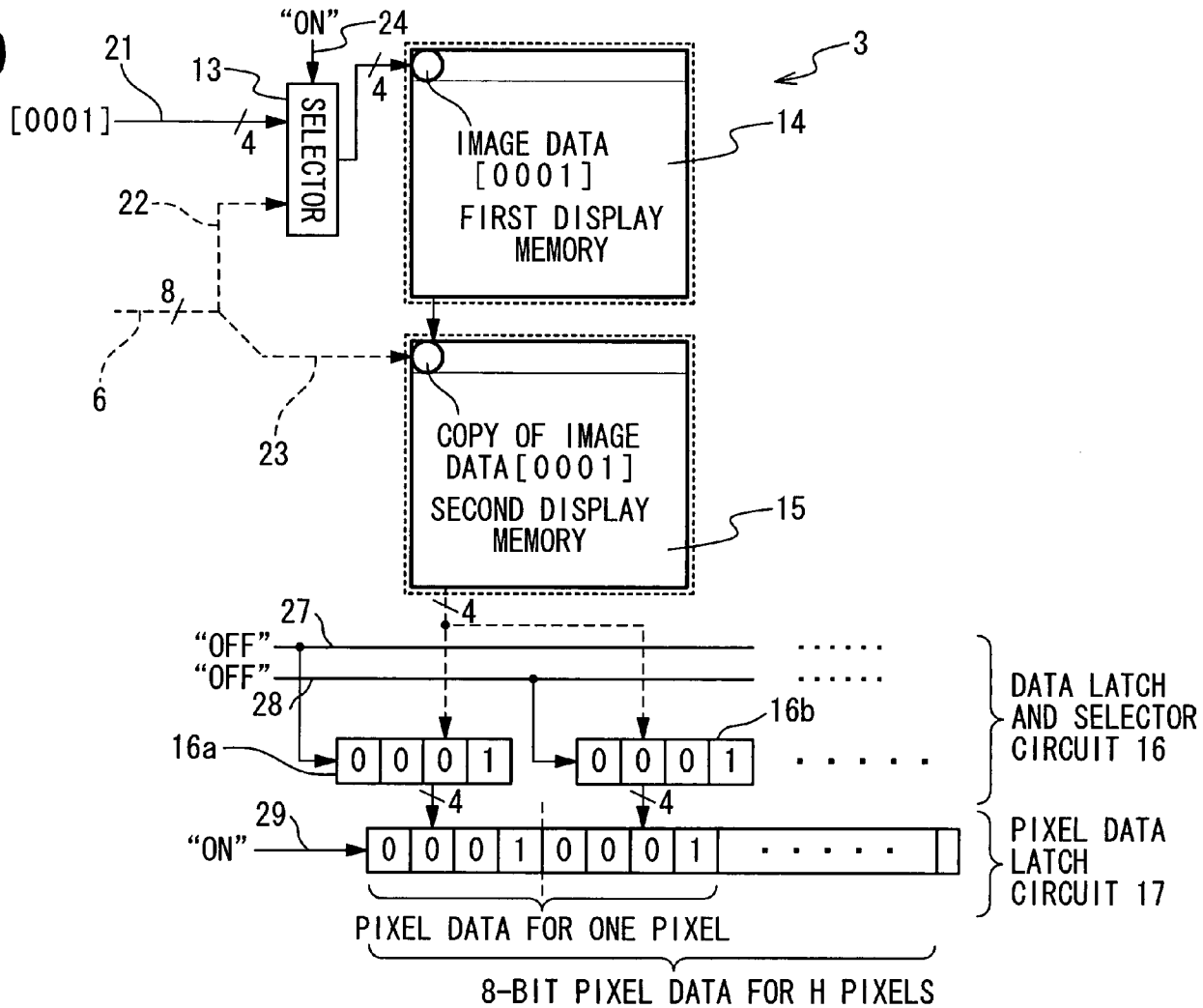

As shown in FIGS. 8 and 9, the "complete" bitmap data stored in the second display memory 15 is then sequentially transferred to the data line driver circuit 18 through the data latch and select circuit 16 and the pixel data latch circuit 17, and the LCD 1 is driven in response to the transferred bitmap data. It should be noted that the bitmap data stored in the first display memory 14 is not directly used for driving the LCD 1.

More specifically, as shown in FIG. 8, the associated portion of the bitmap data stored in the second display memory 15 is transferred to the data latch and selector circuit 16 for the pixels of the selected line. In detail, both of the first and second latch signals 28 and 29 are activated, and the associated portion of the bitmap data stored in the second display memory 15 is latched by both of the first and second latch circuits 16*a* and 16*b*; the data latched by the first and second latch circuits 16*a* and 16*b* are identical.

As shown in FIG. 9, the latch signal 29 is then activated. This allows the data stored in the first and second latch circuits 16*a* and 16*b* to be incorporated each other to develop the pixel data of the pixels of the selected line onto the pixel data latch circuit 17. The developed pixel data is four-bit bitmap data, the upper four bits being identical to the first latch circuit 16*a* and the lower four bits being identical to the second first latch circuit 16*b*. This operation achieves data conversion of the four-bit bitmap data into eight-bit bitmap data.

In response to the pixel data developed onto the pixel data latch circuit 17, the data lines 1*a* are driven by the data line driver circuit 18, while the selected gate line 1*b* is driven by the gate line driver 4. This achieves the desired graylevels on the pixels of the selected line.

The same operation is repeated scanning the gate lines 1*b*. The bitmap data retrieved from the second display memory and 15, and the data lines 1*a* of the LCD 1 are driven in response to the retrieved bitmap data. Completely scanning the gate lines 1*b* achieves displaying one frame image.

In a preferred embodiment, the controller/driver 3 is designed to implement the data conversion of the vector data 5 for the next frame image, while driving the LCD 1 in response to the bitmap data stored in the second display memory and 15. This effectively improves display latency after the vector data 5 is inputted to the controller/driver 3.

As described above, the controller/driver 3 are adapted to both of the vector data 5 and the bitmap data 6 using the first and second display memories 14 and 15. The first and second display memories 14 and 15 are used for two purposes to thereby reduce the circuit size of the controller/driver 3. More specifically, when the vector data 5 is provided for the controller/driver 3, the first display memory 14 functions as the work area with which the image processor circuit 11 converts the vector data 5 into the corresponding bitmap data, while the second display memory 15 functions as the display memory which stores the bitmap data used for driving the LCD 1; the bitmap data developed onto the first display memory 14 is not directly used for driving the LCD 1. This operation allows the controller/driver 3 to convert the vector data 5, which is not adapted to drive the LCD 1, into the corresponding bitmap data, and to drive the LCD 1 in response to the corresponding bitmap data. When the bitmap data 6 is provided for the controller/driver 3, on the other hand, both of the first and second display memories 14 and 15 are used for storing the bitmap data 6; the lower k/2 bits of the bitmap data 6 are stored in the first display memory 14, and the upper k/2 bits are stored in the second display memory 15. This allows the controller/driver 3 to display high quality images on the LCD 1 with the reduced memory size.

4. Preferred Modifications

Figure 10:
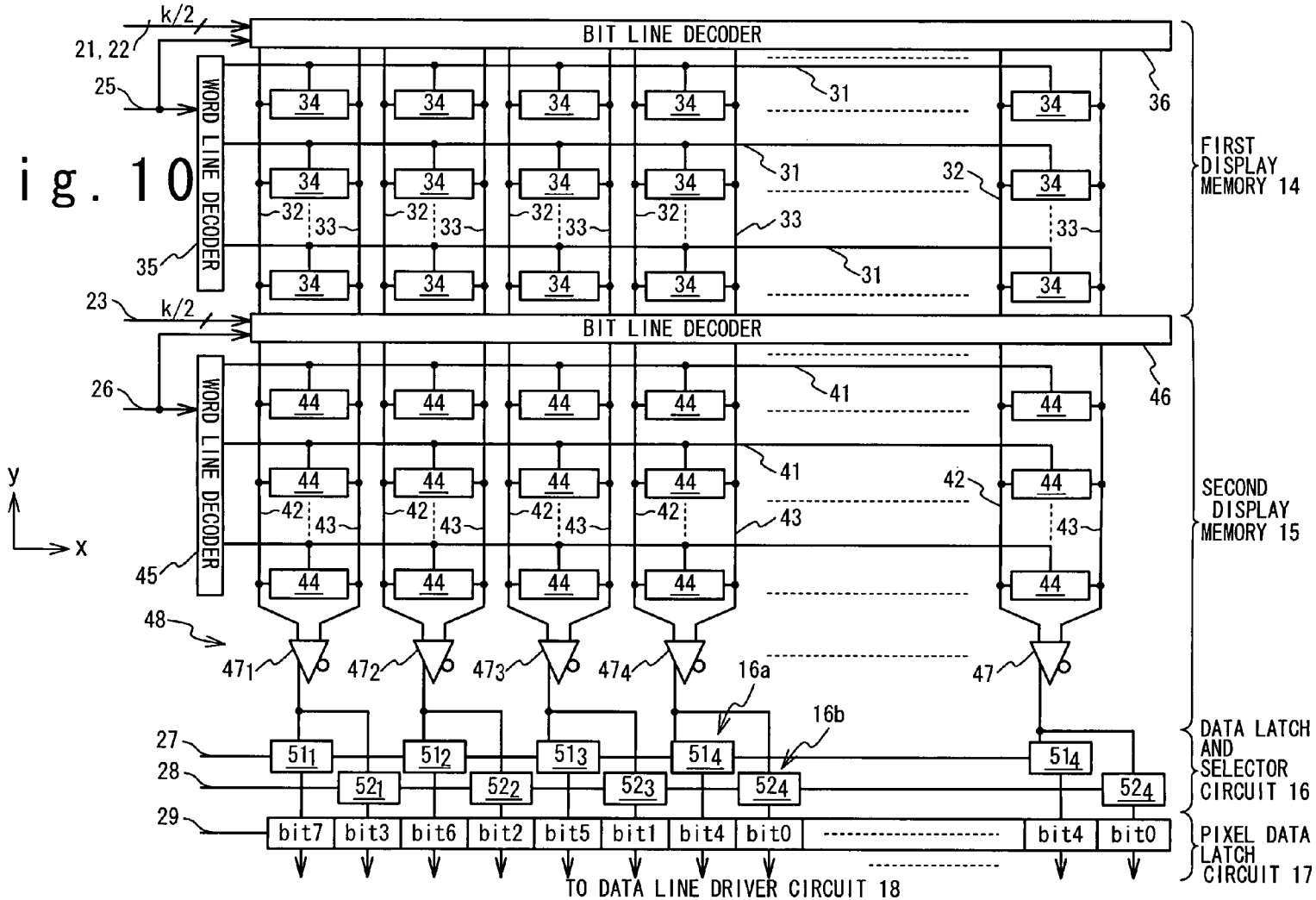
FIG. 10 is a block diagram illustrating a preferred structure of the controller/driver in accordance with the first embodiment.

In this embodiment, as shown in FIG. 10, the latches $\mathbf{51}_1$ to $\mathbf{51}_4$ within the first latch circuit 16*a* and the latches $\mathbf{52}_1$ to $\mathbf{52}_4$ within the first latch circuit 16*b* are alternately arranged in the x-axis direction, which direction is identical to the direction in which the outputs of the data line driver circuit 18. In this case, the latches connected to the latches $\mathbf{51}_1$ to $\mathbf{51}_4$ and the latches connected to the latches $\mathbf{52}_1$ to $\mathbf{52}_4$ are also alternately arranged within the pixel data latch circuit 17. Such arrangement effectively reduces the number of intersections of the interconnections among the sense amplifier 47, the latches $\mathbf{51}_1$ to $\mathbf{51}_4$, and the latches $\mathbf{52}_1$ to $\mathbf{52}_4$. The reduction in the number of the intersections is effective for reducing the area necessary for disposing the interconnections, and also effective for reducing the power consumption of the controller/driver 3.

Alternately disposing the latches $\mathbf{51}_1$ to $\mathbf{51}_4$ and the latches $\mathbf{52}_1$ to $\mathbf{52}_4$ requires that the interconnections used for transferring the upper k/2 bits of the pixel data between the first latch circuit 16*a* and the pixel data latch circuit 17, and the interconnections used for transferring the lower k/2 bits between the second latch circuit 16*b* and the pixel data latch circuit 17 are also alternately arranged in the x-axis direction. This implies that the interconnections used for transferring the upper k/2 bits of the pixel between the pixel data latch circuit 17 and the data line driver circuits 18 and the interconnections used for transferring the lower k/2 bits of the pixel between the pixel data latch circuit 17 and the data line driver circuits 18 are also alternately arranged.

It should be noted, however, that the alternate arrangement of the latches $\mathbf{51}_1$ to $\mathbf{51}_4$ and the latches $\mathbf{52}_1$ to $\mathbf{52}_4$ does not complicate routing of the interconnections within the data line driver circuits 18. The reason is described in the following.

Figure 11:
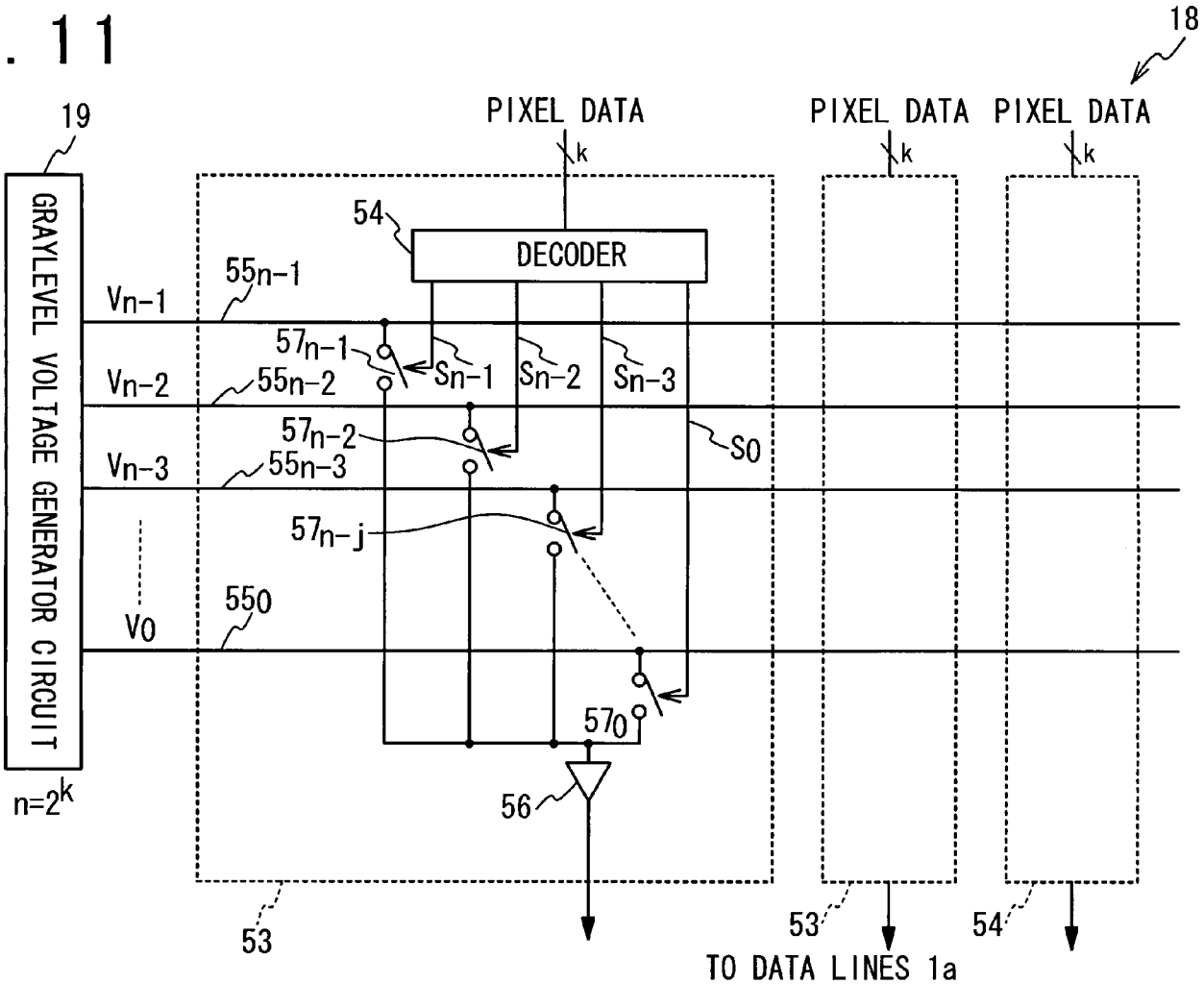
FIG. 11 is a circuit diagram illustrating an exemplary structure of a data line driver circuit within the controller/driver in accordance with the first embodiment.

FIG. 11 is a circuit diagram illustrating an exemplary structure of the data line driver circuit 18. The data line driver circuit 18 is typically composed of selector circuits 53 that are respectively associated with the data lines 1*a* of the LCD 1. The selector circuits 53 are each composed of a decoder 43, grayscale voltage lines $\mathbf{55}_0$ to $\mathbf{55}_{n-1}$, an output amplifier 56, and switches $\mathbf{57}_0$ to $\mathbf{57}_{n-1}$, n being $2^k$. The grayscale voltage lines $\mathbf{55}_0$ to $\mathbf{55}_{n-1}$, receive grayscale voltages $V_0$ to $V_{n-1}$, respectively, from the grayscale voltage generator circuit 19. The switches $\mathbf{57}_0$ to $\mathbf{57}_{n-1}$ are connected between the grayscale voltage lines $\mathbf{55}_0$ to $\mathbf{55}_{n-1}$ and the inputs of output amplifier 56, respectively. The decoder 54 is responsive to the pixel data received from the pixel data latch circuit 17 for providing switch signals $S_0$ to $S_{n-1}$ for the switches $\mathbf{57}_0$ to $\mathbf{57}_{n-1}$; one of the switch signals $S_0$ to $S_{n-1}$ is activated in response to the pixel data. The switches $\mathbf{57}_0$ to $\mathbf{57}_{n-1}$ are turned on in response to the associated switch signals $S_0$ to $S_{n-1}$ being activated.

As is understood from FIG. 10, the layout of the grayscale voltage lines $\mathbf{55}_0$ to $\mathbf{55}_{n-1}$, the output amplifier 56, and the switches $\mathbf{57}_0$ to $\mathbf{57}_{n-1}$ can be arranged independently of the fact that the interconnections transferring the upper k/2 bits of the pixel data and the interconnections transferring the lower k/2 bits are alternately arranged.

The layout of the decoder 54, on the other hand, is required to be adapted to the alternate arrangement of the interconnections; however, the alternate arrangement of the interconnections does not increase the complexity of the decoder 54.

Figure 12:
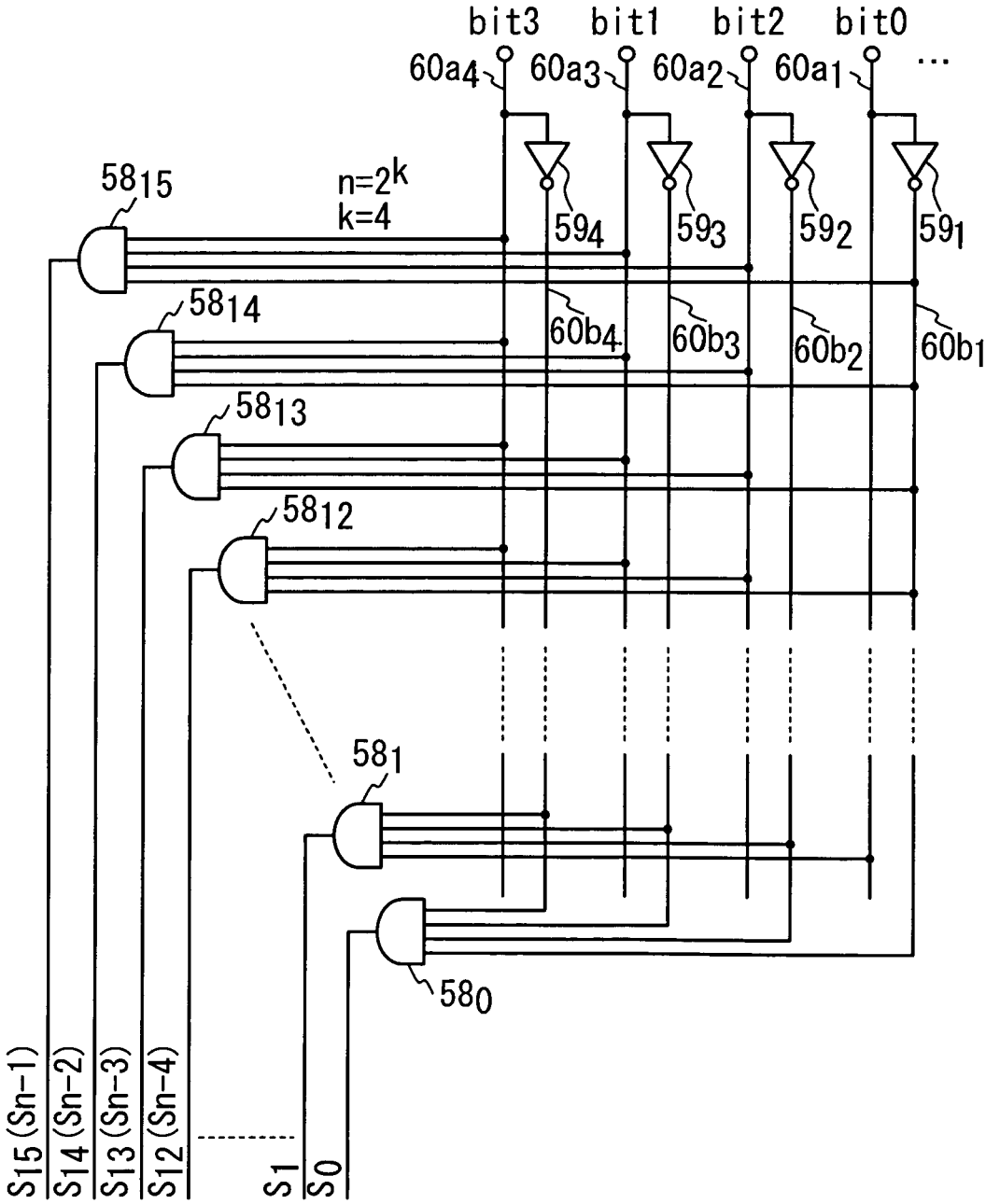
FIGS. 12 and 13 are circuit diagrams illustrating examples of a decoder within the data line driver circuit.
Figure 13:
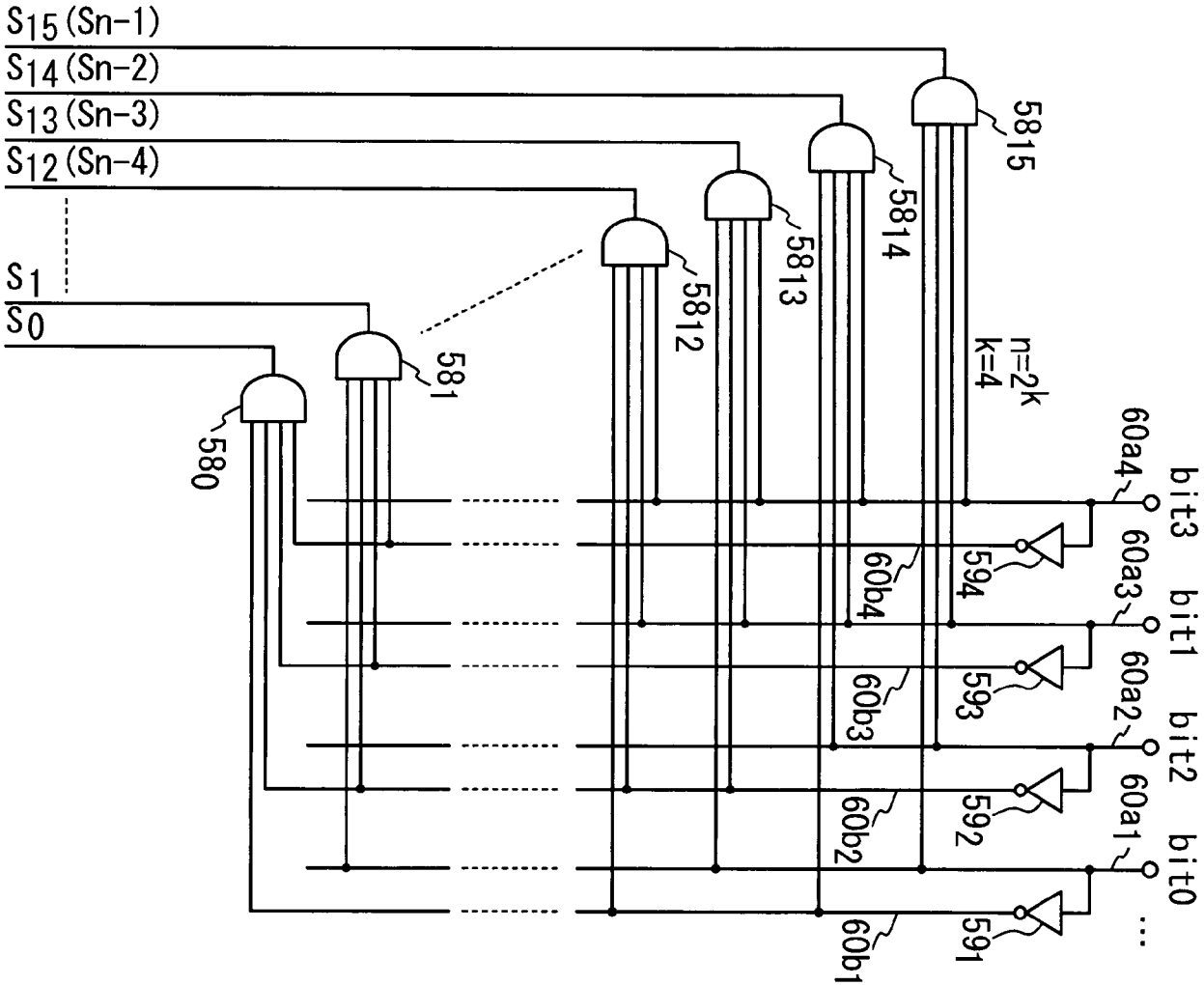

FIG. 12 is a circuit diagram of an exemplary structure of the decoder 54, and FIG. 13 is another diagram of another exemplary structure of the decoder 54; the difference is that the interconnections transferring the upper k/2 bits of the pixel data and the interconnections transferring the lower k/2 bits are alternately arranged in the structure shown in FIG. 12, while the interconnections transferring the lower k/2 bits are all arranged on the one side of the interconnections transferring the upper k/2 bits of the pixel data in the structure shown in FIG. 13. It should be noted that k, which is the number of the data bits for each pixel, is four. In both the structures, the decoder 54 is composed of $2^k$ AND gates $\mathbf{58}_0$ to $\mathbf{58}_{15}$, four inverters $\mathbf{59}_1$ to $\mathbf{59}_4$, four pixel data lines $\mathbf{60}a_1$ to $60a_4$, and complementary pixel data lines $\mathbf{60}b_1$ to $60b_4$; the pixel data lines $\mathbf{60}a_1$ to $\mathbf{60}a_4$ receiving the associated data bits of the pixel data. The inputs of the inverters $\mathbf{59}_1$ to $\mathbf{59}_4$ are connected to the pixel data lines $\mathbf{60}a_1$ to $\mathbf{60}a_4$, and the outputs of the inverters $\mathbf{59}_1$ to $\mathbf{59}_4$ are connected to the complementary pixel data lines $\mathbf{60}b_1$ to $\mathbf{60}b_4$, respectively.

As is understood from FIGS. 12 and 13, the order of the arrangement of the interconnections transferring the upper and lower k/2 bits of the pixel data (that is, the association of the pixel data lines $\mathbf{60}a_1$ to $\mathbf{60}a_4$ with the data bits of the pixel data) only influences the association of the inputs of the AND gates $\mathbf{58}_0$ to $\mathbf{58}_{15}$ with the pixel data lines $\mathbf{60}a_1$ to $\mathbf{60}a_4$ and the complementary pixel data lines $\mathbf{60}b_1$ to $\mathbf{60}b_4$. Therefore, the modification in the order of the arrangement of the interconnections does not complicate the layout of the decoder 54.

Accordingly, the alternate arrangement of the latch $\mathbf{51}_1$ to $\mathbf{51}_4$ and the latch $\mathbf{52}_1$ to $\mathbf{52}_4$ does not complicate the routing of the interconnections within the data line driver circuit 18; rather, the alternate arrangement effectively reduces the number of the intersections of the interconnections as a whole of the controller/driver 3.

In an alternative implementation of the present invention, the upper k/2 bits of the bitmap data 6 (that is, the upper bit data 23) may be transferred to the first display memory 14 in place of the second display memory 15 and the lower k/2 bits of the bitmap data 6 (that is, the lower bit data 22) may be transferred to the second display memory 15 in place of the first display memory 14. In this case, the upper k/2 bits of the bitmap data 6 are transferred from the first display memory 14 to the first latch circuit 16*a*, and the lower k/2 bits of the bitmap data 6 are transferred from the second display memory 15 to the second latch circuit 16*b*.

In another alternative implementation of the present invention, the capacities of the first and second display memories 14 and 15 may be different from each other. When the first display memory 14 has a capacity larger than that of the second display memory 15, the excessive portion of the first display memory 14 may be used as a memory region for storing various data other then the bitmap data for displaying images on the LCD 1.

It should be noted, however, that it is preferable that the capacities of the first and second display memories 14 and 15 are same. When the second display memory 15 has a capacity larger than that of the first display memory 14, for example, the excessive portion of the second display memory 15 is of no use. In order to avoid this disadvantage, the capacity of the first display memory 14 is preferably identical to that of the second display memory 15.

Second Embodiment

1. Structure of the Controller/Driver

Figure 14:
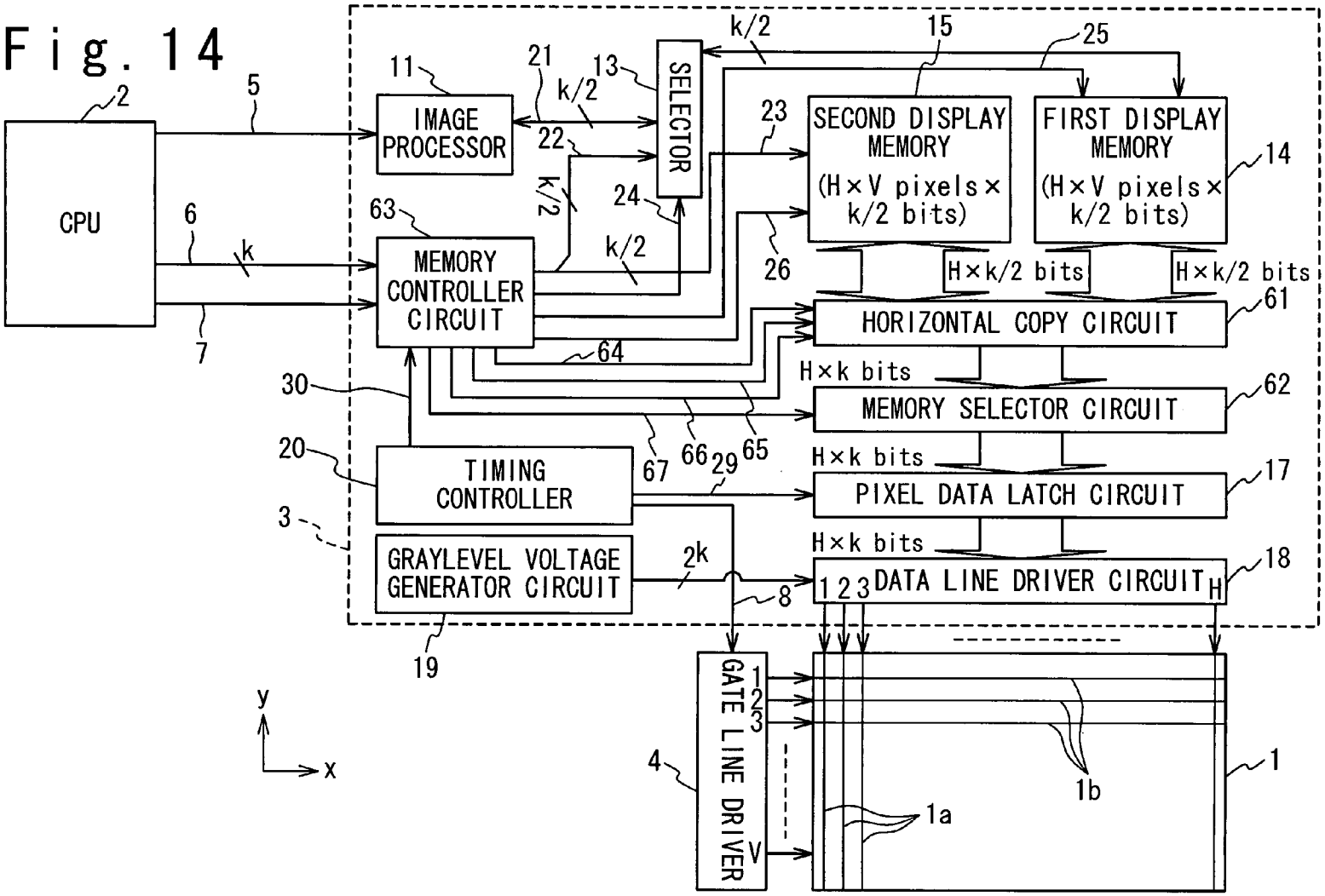
FIG. 14 is a block diagram illustrating an exemplary structure of a controller/driver in accordance with a second embodiment of the present invention.

FIG. 14 is a block diagram illustrating an exemplary structure of the controller/driver in a second embodiment of the present invention. In the second embodiment, the first and second display memories 14 and 15 are arranged in the x-axis direction, that is, the direction in which the outputs of the data line driver circuit 18 are arranged. The first and second display memories 14 and 15 are connected to the pixel data latch circuit 17 through a horizontal copy circuit 61 and a memory selector circuit 62. It should be noted that the architecture in this embodiment allows the first display memory 14 to transfer the bitmap data to the pixel data latch circuit 17 not through the second display memory 15.

The arrangement of the first and second display memories 14 and 15 in this embodiment has two advantages over the first embodiment. Firstly, this arrangement allows the first and second display memories 14 and 15 to output the image data to the pixel data latch circuit 17 at the same time. This effectively reduces the duration necessary for transferring the image data from the first and second display memories 14 and 15 to the pixel data latch circuit 17, and thereby effectively improves the operating speed of the controller/driver 3.

Secondly, arranging the first and second display memories 14 and 15 in the x-axis direction effectively reduces the length of the controller/driver 3 in the y-axis direction (that is, the direction of the bit lines of the first and second display memories 14 and 15). This is especially effective when the LCD 1 and the controller/driver 3 are provided on the same glass substrate, that is, when a COG (chip on glass) technique is applied to the system. When a COG technique is used, the increase in the length of the controller/driver 3 in the vertical direction (y-axis direction) directly leads to the increase in the size of the glass substrate, and undesirably increases the cost. Accordingly, arranging the first and second display memories 14 and 15 in the x-axis direction is especially effective when the LCD 1 and the controller/driver 3 are provided on the same glass substrate.

The following is a detailed description of the controller/driver 3 in the second embodiment.

In the second embodiment, as illustrated in FIG. 14, the memory controller circuit 12 is replaced with a memory controller circuit 63, and the data latch and selector circuit 16 is replaced with the horizontal copy circuit 61 and the memory selector circuit 62.

The memory controller circuit 63 is designed to provide first and second latch signals 64, and 65, and a copy control signal 66 for the horizontal copy circuit 66, and to provide a memory select signal 67. Other functions of the memory controller circuit 63 are identical to those of the memory controller circuit 12 in the first embodiment with exception that the memory controller circuit 63 does not control the data latch and selector circuit 16, which is not included in the controller/driver 3 in this embodiment.

The horizontal copy circuit 61 is designed to develop a copy of the image data stored in the first display memory 14 onto the second display memory 15. Additionally, the horizontal copy circuit 61 is designed to transfer the image data stored in the first and second display memories 14 and 15 to the memory selector circuit 62 in response to the first and second latch signals 64 and 65. The memory selector circuit 62 is responsive to the memory select signal 67 to transfer both the image data received from the first and second display memories 14 and 15 to the data line driver circuit 18, or to transfer only the image data received from the second display memory 15 to the data line driver circuit 18.

Figure 15:
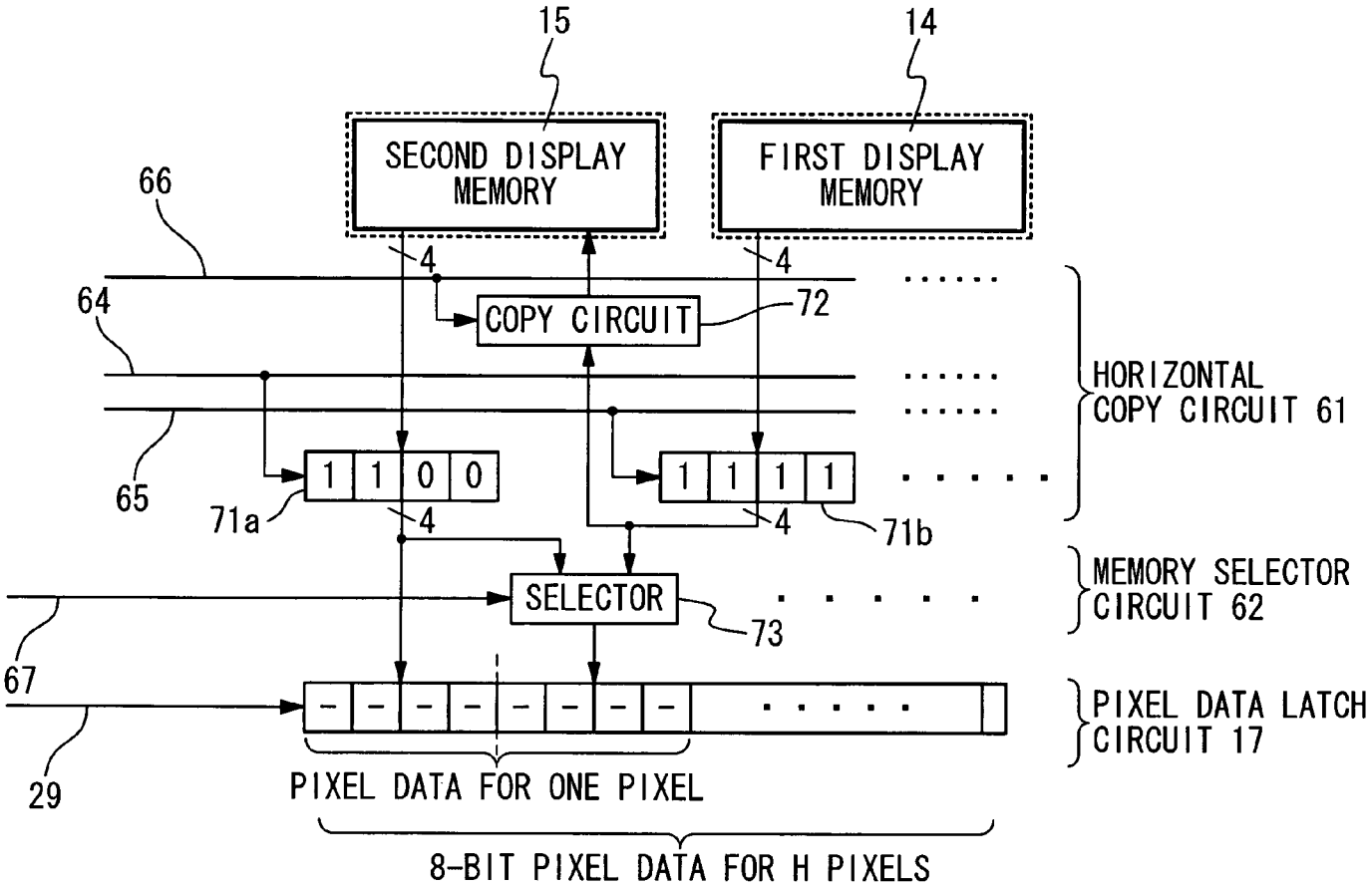
FIG. 15 is a block diagram illustrating exemplary structures of a horizontal copy circuit and a memory selector circuit within the controller/driver in accordance with the second embodiment.

FIG. 15 is a block diagram illustrating exemplary structures of the horizontal copy circuit 61 and the memory selector circuit 62. The horizontal copy circuit 61 is composed of H first latch circuits 71*a*, H second latch circuits 71*b*, and H copy circuits 72 (each one shown), H being the number of the data lines 1*a* of the LCD 1. The first and second latch circuits 71*a* and 71*b* each have a function of latching k/2 data bits in parallel. The first latch circuits 71*a* are responsive to the first latch signal 64 to latch the image data stored in the second display memory 15. Correspondingly, the second latch circuits 72*b* are responsive to the second latch signal 65 to latch the image data stored in the first display memory 14. The copy circuits 72 are responsive to the copy control signal 66 to transfer the data latched by the second latch circuits 71*b* to the second display memory 15. The copy circuits 72 are used for copying the image data stored in the first display memory 14 onto the second display memory 15.

The memory selector circuit 62 is composed of selector circuits 73 (one shown). The selector circuits 73 select the data latched by the first latch circuits 71*a* and that latched by the second latch circuits 71*b* to output to the pixel data latch circuit 17. The pixel data latch circuit 17 receives the data latched by the first and second latch circuits 71*a* and 71*b* to develop the pixel data used for driving the LCD 1; the data received from the first latch circuits 71*a* are used as the upper k/2 bits of the pixel data, while the data received from the second latch circuits 71*b* are used as the lower k/2 bits of the pixel data. The pixel data latch circuit 17 provides the pixel data developed thereon for the data line driver circuit 18.

An exemplary operation of the controller/driver 3 in this embodiment will be described below, assuming that k being 8.

(1) LCD Drive in Response to Bitmap Data

When receiving the bitmap data 6 from the CPU 2, the controller/driver 3 drives the LCD 1 in response to the bitmap data 6. In this case, the image processor circuit 11 is deactivated. The LCD drive in response to the bitmap data 6 involves the following Steps S11 and S12.

Step S11: Write Operation of the Bitmap Data 6

Figure 16:
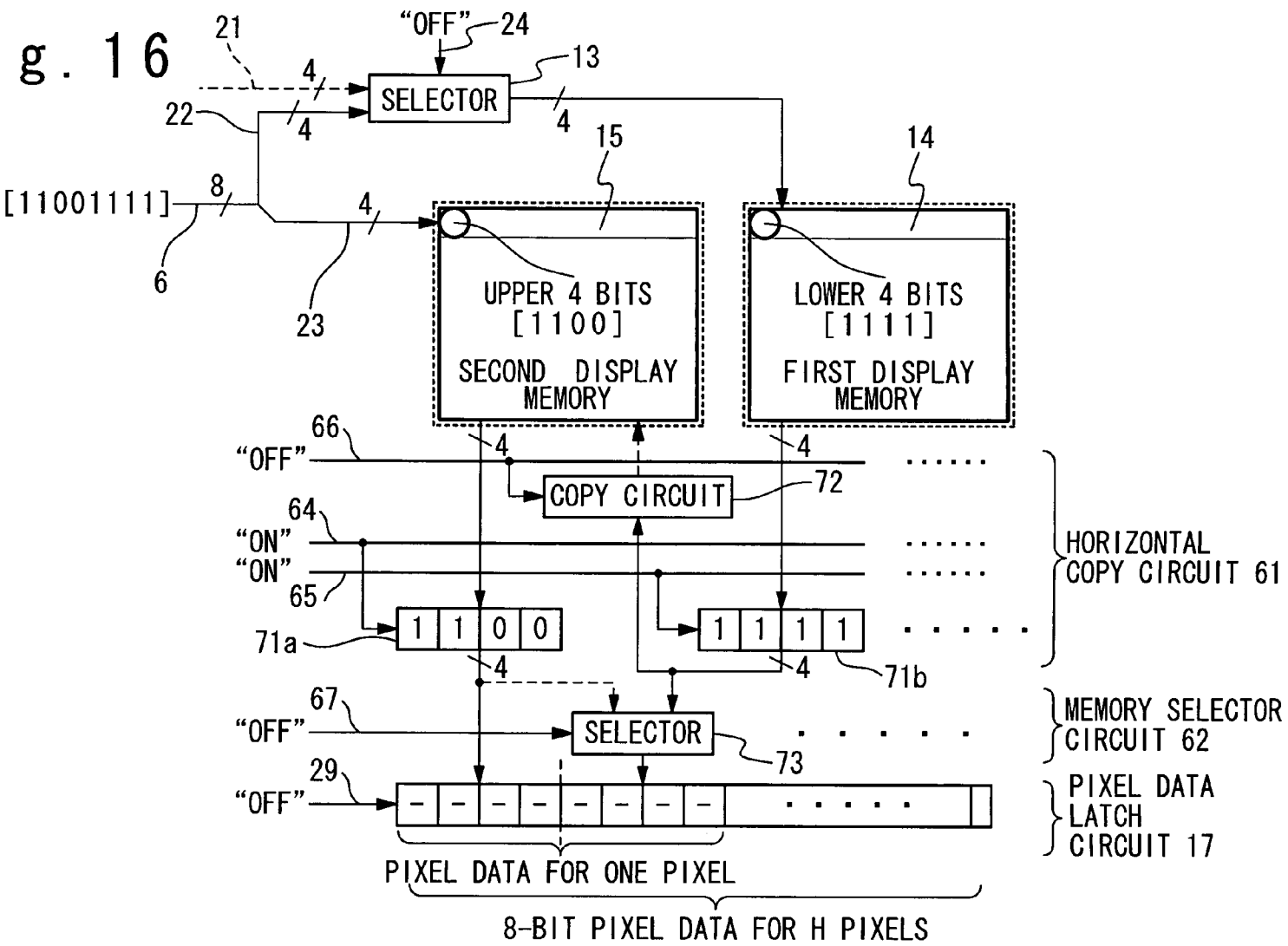
FIGS. 16 to 20 are block diagrams schematically illustrating an exemplary operation of the controller/driver in accordance with the second embodiment.

With reference to FIG. 16, the bitmap data 6 is dividedly stored in the first and second display memories 14 and 15. The memory controller circuit 63 divides the bitmap data 6 into the lower and upper bit data 22 and 23. The lower bit data 22 is provided for the selector 13, and the upper bit data 23 is provided for the second display memory 15. In response to the data selector signal being deactivated by the memory controller circuit 63, the selector 13 selects the lower bit data 22 to output the first display memory 14. The lower bit data 22 is stored in the first display memory 14, while the upper bit data 23 is stored in the second display memory 15. For example, when a graylevel of a specific pixel is represented by "11001111" in the bitmap data 6, "1111" is stored in the first display memory 14 and "1100" is stored in the second display memory 15.

Step S12: LCD Drive

Next, the bitmap data 6, dividedly stored in the first and second display memories 14 and 15, is transferred to the data line driver circuit 18 through the horizontal copy circuit 61, the memory selector circuit 62, and the pixel data latch circuit 17, and the LCD 1 is driven in response to the transferred bitmap data 6. Pixel data transfer from the first and second display memories 14 and 15 to the data line driver circuit 18 is achieved as described in the following.

Firstly, the pixel data associated with the pixels of the selected line are retrieved from the first and second display memories 14 and 15, and then transferred to the pixel data latch circuit 17. More specifically, as shown in FIG. 16, the first latch signal 64 is activated to allow the first latch circuit 71*a* to latch the associated portion of the upper bit data 23 for the pixels of the selected line from the second display memory 15. In the mean time, the second latch signal 65 is activated to allow the second latch circuit 71*b* to latch the associated portion of the lower bit data 22 for the pixels of the selected line from the first display memory 14.

Figure 17:
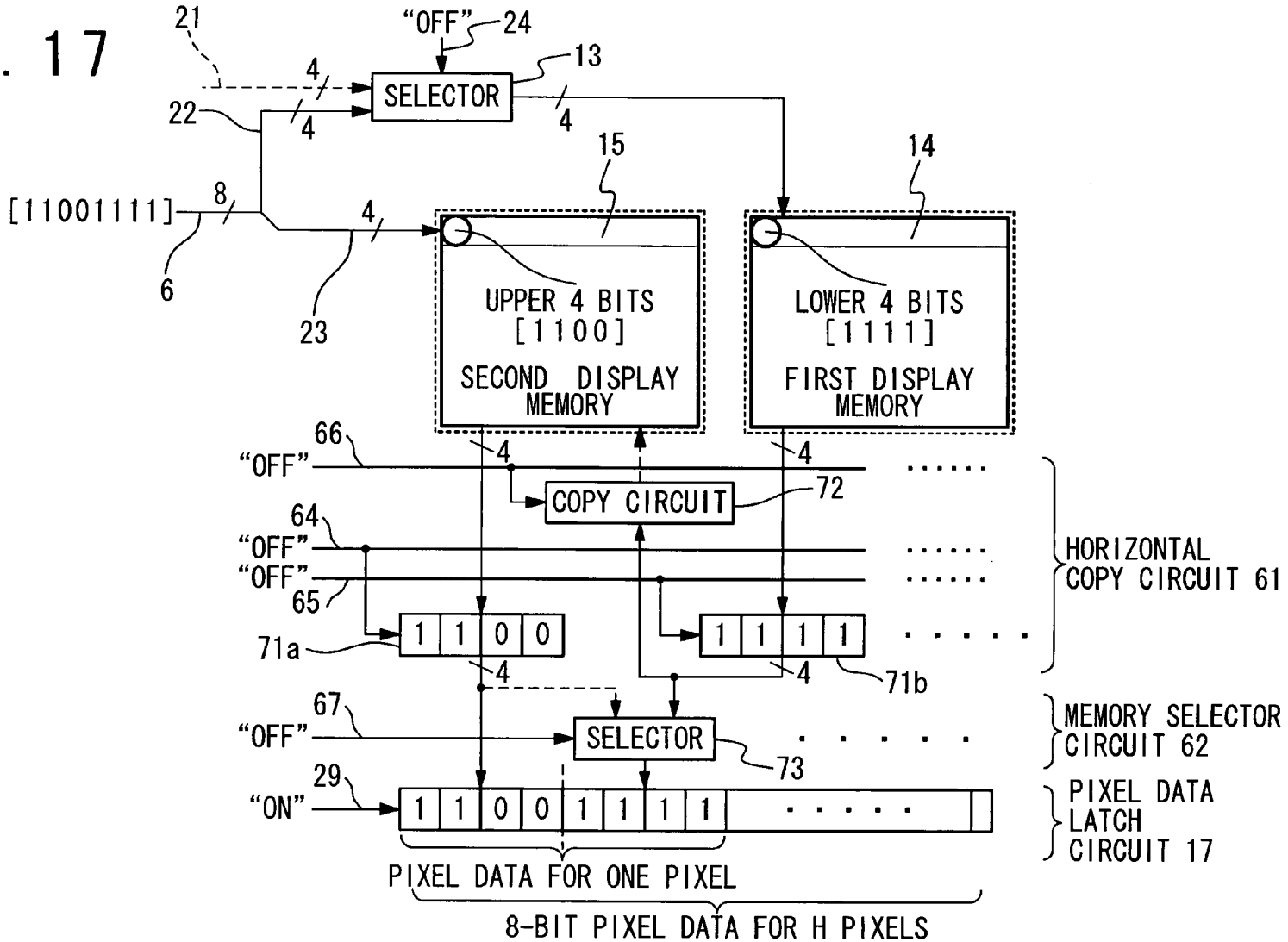

As shown in FIG. 17, this is followed by deactivating the memory select signal 67, and thereby allowing the selector 73 to select the second latch circuits 71*b*. Additionally, the latch signal 29 is activated at the same time. In response to the latch signal 29 being activated, the data latched in the latch circuits 71*a* and 71*b* are transferred to the pixel data latch circuit 17 to develop the pixel data. The upper four bits of the pixel data developed onto the pixel data latch circuit 17 are the data stored in the first latch circuits 71*a*, and the lower four bits are the data stored in the second latch circuits 71*b*.

The data lines 1*a* of the LCD 1 are then driven by the data line driver 18, in response to the pixel data developed onto the pixel data latch circuit 17, while the selected gate line 1*b* is activated by the gate line driver 4. The same goes for the remaining gate lines 1*b*; the gate lines 1*b* are scanned by the gate line driver 4, and the data lines 1*a* are driven by the data line driver 18 for each gate line 1*b*. Completely scanning the gate lines 1*b* achieves displaying one frame image.

(2) LCD Drive in Response to Vector Data

When receiving the vector data 5 from the CPU 2, the controller/driver 3 drives the LCD 1 in response to the vector data 5. The vector data 5 is firstly converted into bitmap data by the image processor circuit 11, and the LCD 1 is driven in response to the bitmap data obtained from the vector data 5. The LCD drive in response to the vector data 5 involves the following Steps S13 to S15.

Step S13: Vector Data Conversion

The LCD drive in response to the vector data 5 begins with converting the vector data 5 to develop the corresponding bitmap data onto the first display memory 14. The data conversion is implemented as described in the first embodiment, and therefore, the detailed explanation of the data conversion is not given.

Step S14: Transferring Bitmap Data

Figure 18:
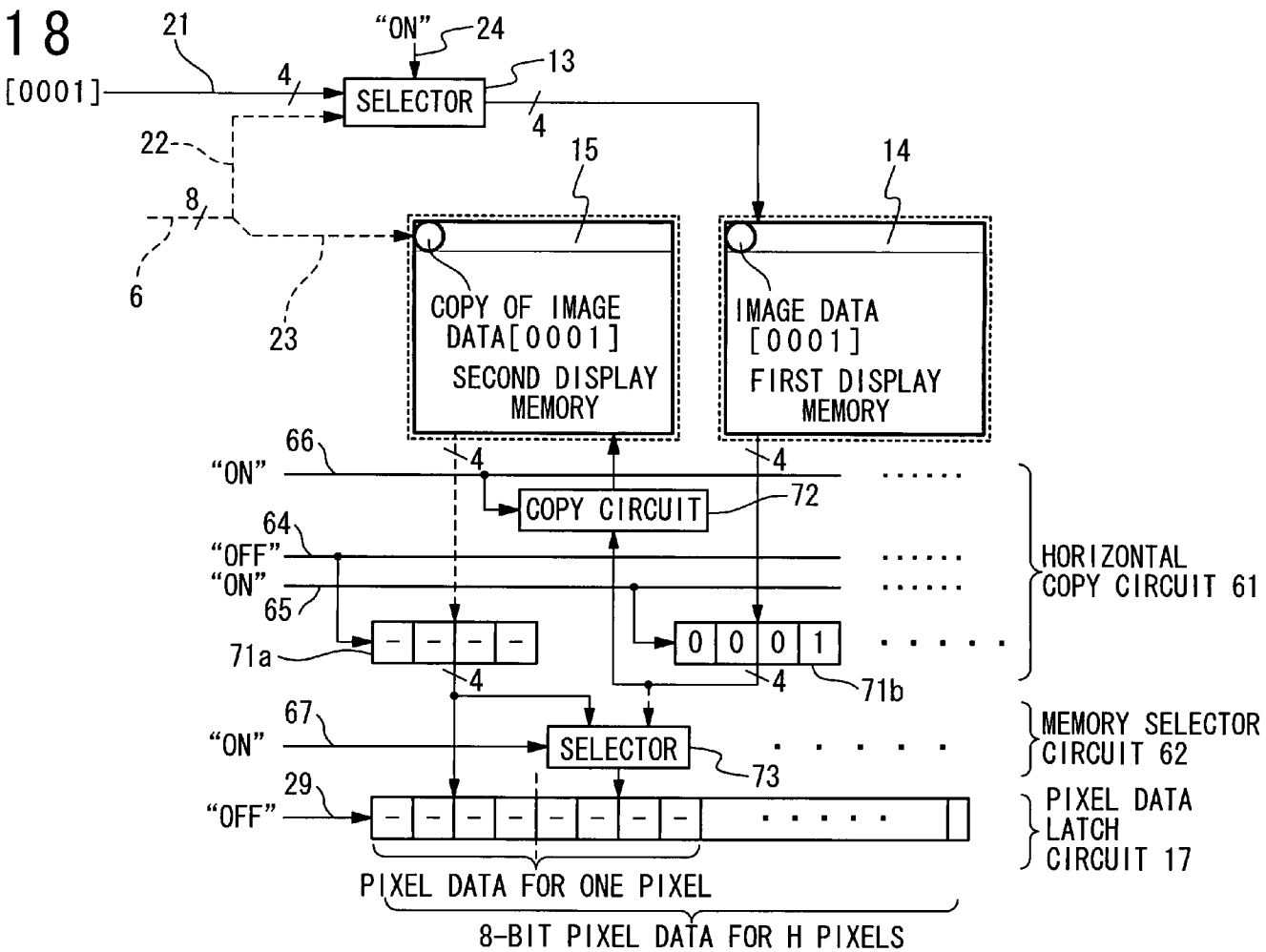
Figure 19:
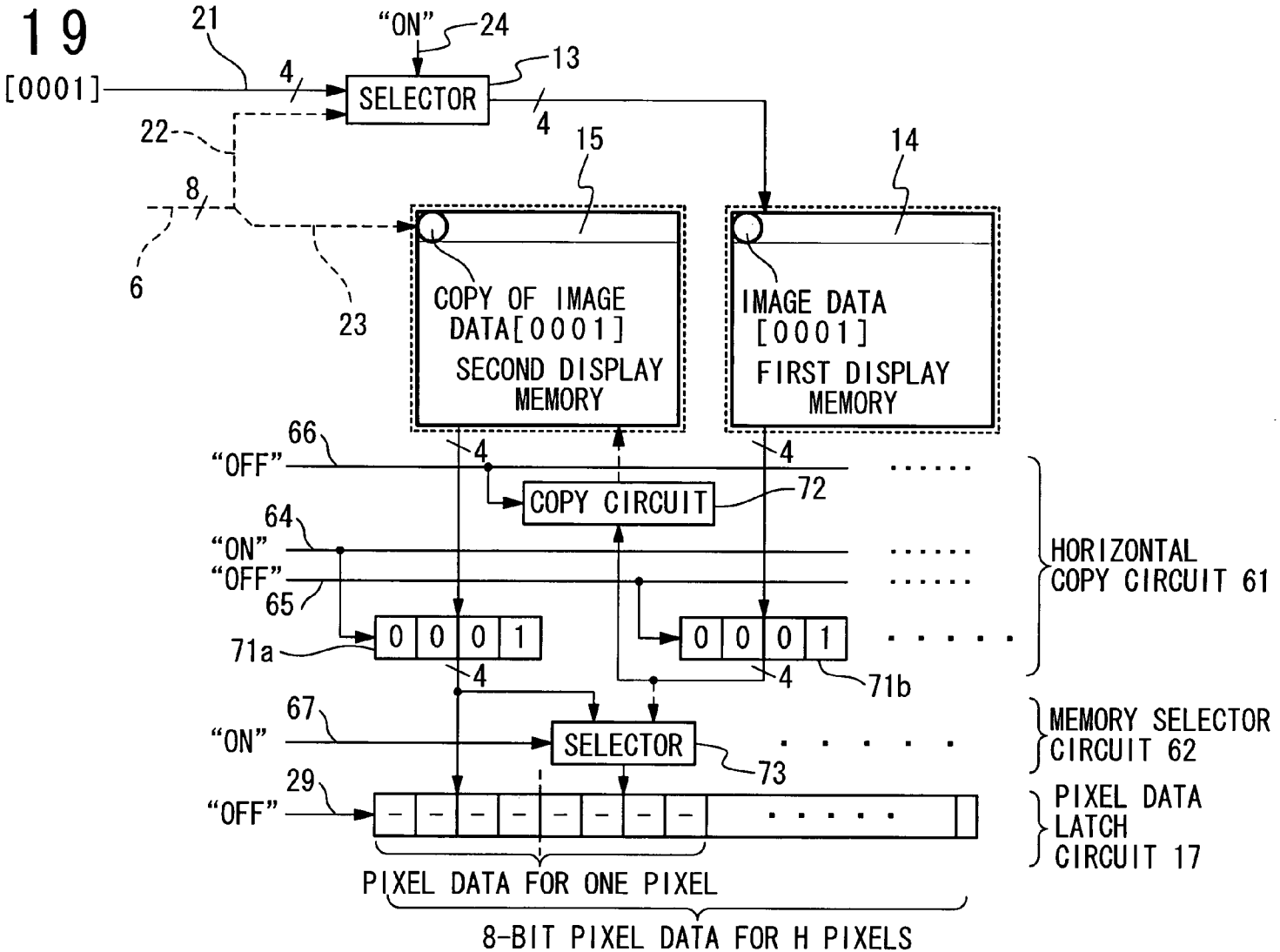
Figure 20:
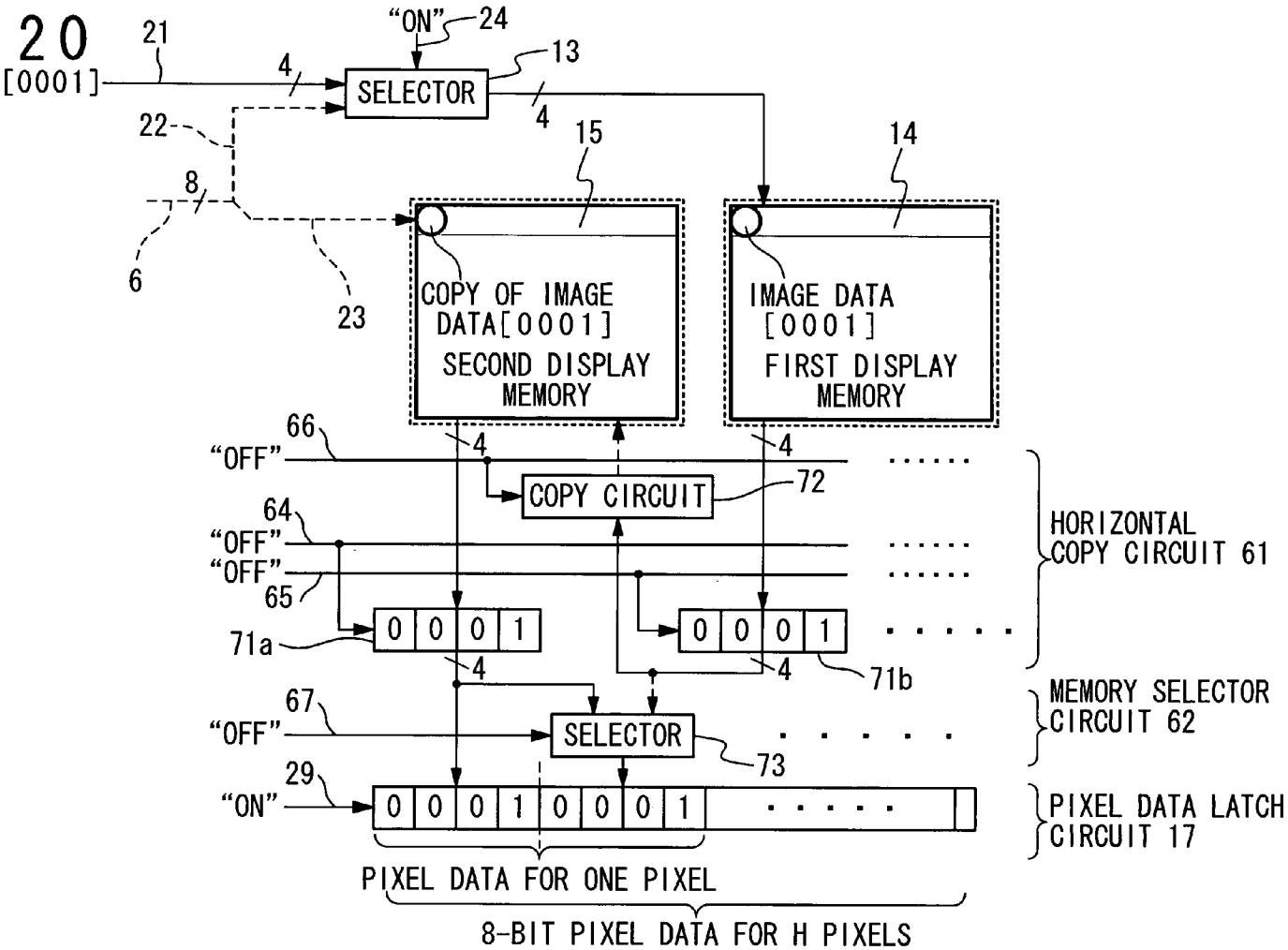

As shown in FIG. 18, the bitmap data developed onto the first display memory 14 is transferred to the second display memory 15. In detail, one of the word lines of the first display memory 14 is selected, and the bitmap data associated with the selected word line is retrieved from the associated memory cells. The retrieved data is then transferred to the second latch circuits 71*b* in response to the activation of the second latch signal 65. This is followed by activating the copy control signal 66 to allows the data latched by the second latch circuits 71*b* to be transferred to the second display memory 15 through the copy circuit 72. The second display memory 15 stores therein the transferred data. The same goes for the remaining word lines, scanning the word lines. This completes the data transfer of the whole bitmap data from the first display memory 14 to the second display memory 15.

Step S15: LCD Drive

The bitmap data stored in the second display memory 15 is then sequentially transferred to the pixel data latch circuit 17, and the LCD 1 is driven in response to the transferred bitmap data; the data stored in the first display memory 14 is not directly used for driving the LCD 1.

More specifically, the memory select signal 67 is activated to allow the selector 73 to select the first latch circuits 71*a*.

In the meantime, the latch signal 29 is activated. In response to the activation of the latch signal 29, the data stored in the first latch circuits 71*a* is transferred to the pixel data latch circuit 17 to develop the pixel data associated with the pixels of the selected line. The data directly transferred from the first latch circuits 71*a* to the pixel data latch circuit 17 is used as the upper four bits of the pixel data, while the data transferred through the selector 73 is used as the lower four bits of the pixel data. In other words, both of the upper and lower four bits of the pixel data are identical to those of the data latched by the first latch circuits 71*a*. Such operation achieves data conversion of the 4-bit bitmap data stored in the second display memory 16 into the 8-bit bitmap data, which is developed onto the pixel data latch circuit 17.

The data lines 1*a* of the LCD 1 are then driven by the data line driver 18 in response to the pixel data developed onto the pixel data latch circuit 17, while the selected gate line 1*b* is activated by the gate line driver 4. The same goes for the remaining gate lines 1; the gate lines 1*b* are scanned by the gate line driver 4, and the data lines 1*a* are driven by the data line driver 18 for each gate line 1*b*. Completely scanning the gate lines 1*b* achieves displaying one frame image.

As thus-described, the controller/driver 3 in the second embodiment, as is the case of the first embodiment, is designed to use the first and second display memories 14 and 15 for two purposes; this allows the controller/driver 3 to be adapted to both of the vector data 5 and the bitmap data 6 with the reduced memory size.

An additional advantage of the second embodiment is that the length of the controller driver 3 in the y-axis direction is effectively reduced through arranging the first and second display memories 14 and 15 in the x-axis direction (or the horizontal direction). This is also effective for improving the operating speed of the controller driver 3.

It should be noted that the present invention is not limited to that the first and second display memories 14 and 15, the horizontal copy circuit 61, the memory selector circuit 62, and the pixel data latch circuit 17 are physically (or mechanically) separated, that is, integrated into different semiconductor chips. It should be especially noted that the first and second display memories 14 and 15 are required to be only logically separated, and thus the first and second display memories 14 and 15 may be monolithically integrated.

Figure 21A:
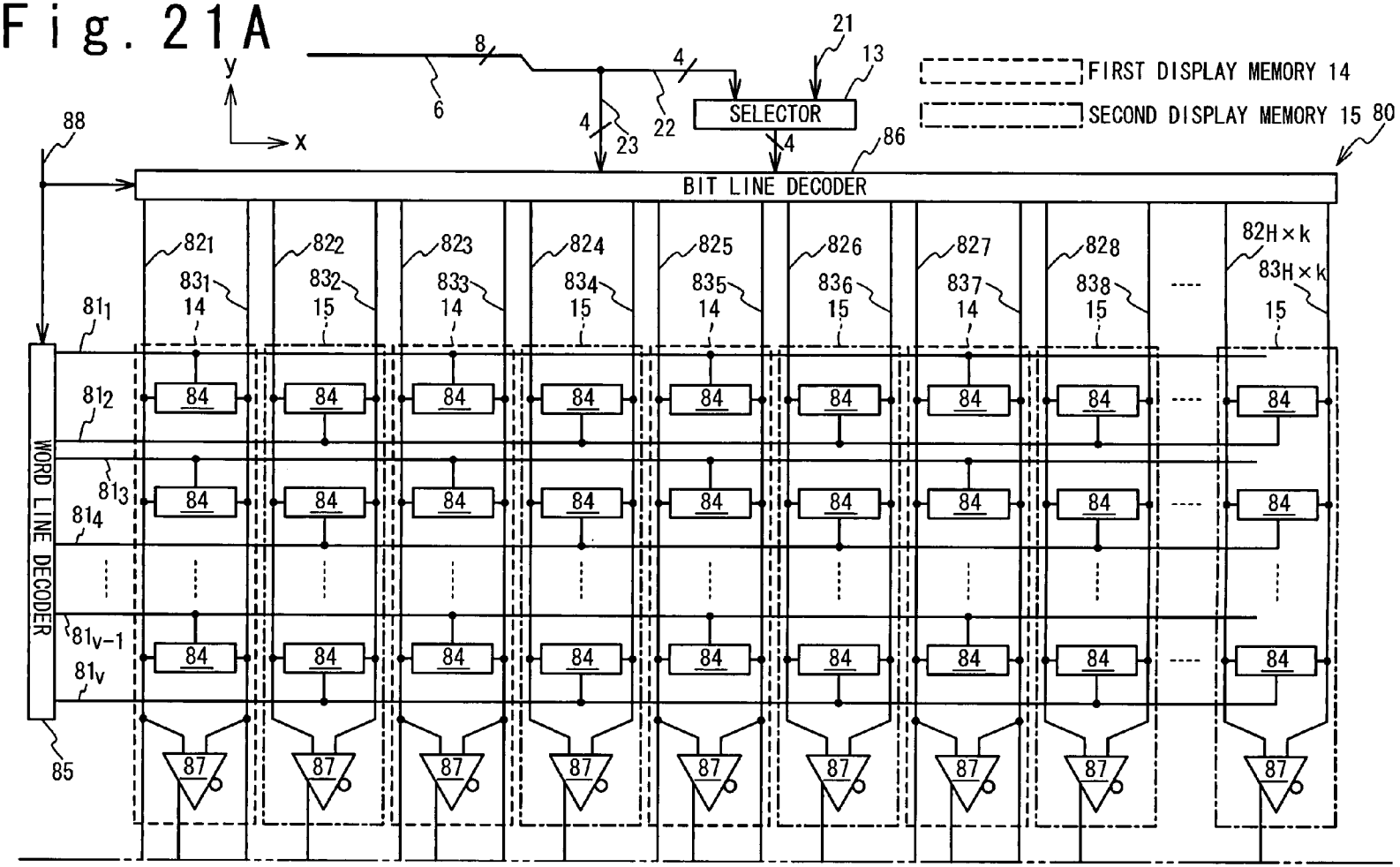
FIGS. 21A and 21B are a block diagram illustrating another structure of the controller/driver in accordance with the second embodiment, in which first and second memories are monolithically integrated.
Figure 21B:
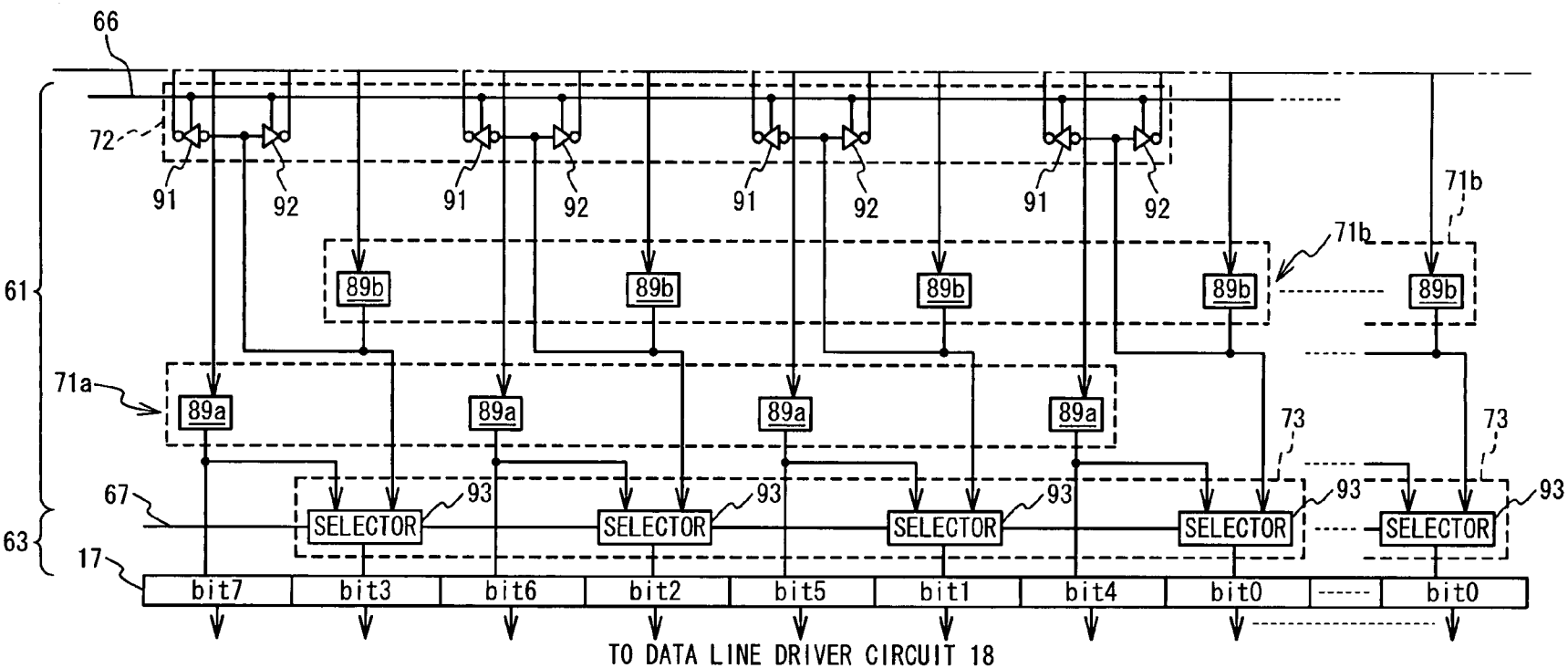

FIGS. 21A and 21B are circuit diagrams illustrating a preferred structure of an integrated circuit 74 into which the first and second display memories 14 and 15, the horizontal copy circuit 61, the memory selector circuit 62, and the pixel data latch circuit 17 are monolithically integrated. The integrated circuit 74 is composed of a memory section 75 used as the first and second display memories 14 and 15, in addition to the horizontal copy circuit 61, the memory selector circuit 62, and the pixel data latch circuit 17.

As illustrated in FIG. 21A, the memory section 75 is composed of word lines $\mathbf{81}_1$ to $\mathbf{81}_V$, bit lines $\mathbf{82}_1$ to $\mathbf{82}_{(H\times k)}$, complementary bit lines $\mathbf{83}_1$ to $\mathbf{83}_{(H\times k)}$, memory cells 84 arranged in V rows and (H×k) columns, a word line decoder 85, a bit line decoder 86, and sense amplifiers 87. The complementary bit lines 83 are one-to-one associated with the bit lines 82, and each complementary bit line 83 has a voltage complementary to the associated bit line 82. One bit line 82 and the associated complementary bit line 83 are collectively referred to as a bit line pair. The memory cells 84 are arranged at the respective intersections of the word lines 81 and the bit line 82. Each memory cell 84 is connected to the associated word line 81, bit line 82 and complementary bit line 83. The word line decoder 85 is responsive to memory control signals 88 received from the memory control circuit 63 to activate selected one of the word lines 81. It should be noted that the memory control signals 88 are equivalent to the memory control signals 25 and 26 shown in FIG. 14. The bit line decoder 86 is responsive to the memory control signals 88 to develop voltages corresponding to the data received from the selector 13 (that is, the intermediate work data 21 or the lower bit data 22) onto the bit line 82 and complementary bit line 83 associated with the destination of the received data. The sense amplifiers 87 each compare the voltages of the associated bit line 82 and complementary bit line 83 to identify the data developed on the associated bit line 82. The identified data are outputted from the sense amplifiers 87.

In the memory section 75, the first display memory 14 in the second embodiment is constituted of the even-numbered bit lines $\mathbf{82}_2$, $\mathbf{82}_4$, . . . , $\mathbf{82}_{(H\times k)}$, the even-numbered complementary bit lines $\mathbf{83}_2$, $\mathbf{83}_4$, . . . , $\mathbf{83}_{(H\times k)}$, and the memory cells 84 and sense amplifiers 87 connected thereto. Correspondingly, the second display memory 14 in the second embodiment is constituted of the odd-numbered bit lines $\mathbf{82}_1$, $\mathbf{82}_3$, . . . $\mathbf{82}_{(H\times k)-1}$, the even-numbered complementary bit lines $\mathbf{83}_1$, $\mathbf{83}_3$, . . . $\mathbf{82}_{(H\times k)0-1}$ and the memory cells 84 and sense amplifiers 87 connected thereto. The columns of the memory cells 84 used as the first display memory 14, and the columns of the memory cells 84 used as the second display memory 15 are alternately arranged in the x-axis direction.

As illustrated in FIG. 21B, the first latch circuits 71*a* within the horizontal copy circuit 61 are each composed of a plurality of latches 89*a*, while the second latch circuits 71*b* are each composed of a plurality of latches 89*b*. The latches 89*a* within the first latch circuits 71*a* and the latches 89*b* within the second latch circuits 71*b* are alternately arranged in the x-axis direction. The latches 89*a* are respectively connected to the sense amplifiers 87 within the second display memory 15, and the latches 89*b* are respectively connected to the sense amplifiers 87 within the first display memory 15. The latches 89*a* are responsive to the first latch signal 64 (not shown in FIG. 21B) for latching the outputs of the associated sense amplifiers 87, and the latches 89*b* are responsive to the second latch signal 65 (not shown in FIG. 21B) for latching the outputs of the associated sense amplifiers 87.

The copy circuits 72 within the horizontal copy circuit 61 are each composed of a buffer 91 and an inverter 92. The inputs of the buffers 91 are connected to the outputs of the associated latches 89*b* within the second latch circuits 71*b*, and the outputs of the buffers 91 are connected to the associated bit lines 82 within the second display memory 15. Correspondingly, the inputs of the inverters 92 are connected to the outputs of the associated latches 89*b* within the second latch circuits 71*b*, and the outputs of the inverters 92 are connected to the associated complementary bit lines 83 within the second display memory 15.

The buffers 91 and the inverters 92 are used for transferring the data stored in the first display memory 14 to the second display memory 15. In response to the activation of the copy control signal 66, the buffers 92 transfer the data stored in the latches 89*b* to the bit lines 82 within the second display memory 15, and the inverters 93 develop data complementary to the data stored in the latches 89*b* onto the complementary bit lines 83 within the second display memory 15. In response to the activation of the selected word line 81 after the data transfer, the data developed onto the bit lines 83 are stored in the memory cells 84 connected to the selected word line 81.

The selector circuits 73 are each composed of selectors 93. The first input of each selector 93 is connected to the output of the associated latch 89*a*, and the second input of each selector 93 is connected to the output of the associated latch 89*b*. The outputs of the selectors 93 are respectively connected to the latches within the pixel data latch circuit 17.

The memory cells 84 belonging to the first display memory 14 and the memory cells 84 belonging to the second display memory 15 are alternately arranged in the x-axis direction (or the horizontal direction). Correspondingly, the latches 89*a* within the first latch circuits 71*a* and the latches 89*b* within the second latch circuits 71*b* are alternately arranged in the x-axis direction. Furthermore, among the latches within the pixel data latch circuit 17, those connected to the latches 89*a* (that is, those receiving the data from the memory cells 84 belonging to the second display memory 15), and those connected to the outputs of the selectors 93 are also alternately arranged in the s-axis direction. Such arrangement effectively reduces the intersections of the interconnections disposed among the first and second display memories 14 and 15, the horizontal copy circuit 61, the memory select circuit 62, and the pixel data latch circuit 17. The reduction in the intersections of the interconnections effectively reduces the area necessary for the interconnections, and the power consumption of the controller/driver 3.

Although the invention has been described in its preferred form with a certain degree of particularity, it is apparent that the present disclosure of the preferred form may be modified or changed in the details of construction without departing from the scope of the invention as hereinafter claimed.

Especially, it should be noted that the memory controller circuit may be configured to determine the data form of the image data received from the CPU, and to change the operation thereof in response to the determined form. In this case, the memory controller circuit is not responsive to the memory control signal, which includes the data mode signal, for dealing with the bitmap data and the vector data.

What is claimed is:

1. A controller/driver comprising:

a control section dividing first bitmap image data representative of $n_1$ grayscale image into first and second data pieces, $n_1$ being a natural number;

a first memory section storing first storage data selected out of said first data piece and second bitmap image data representative of $n_2$ grayscale image, $n_2$ being smaller than $n_1$;

a second memory section storing second storage data selected out of said second data piece and said first storage data received from said first memory section; and a driver section for driving data lines of a display panel in response to said first and second storage data stored in said first and second memory sections, respectively, wherein said second data piece is selected as said second storage data to be stored in said second memory section, when said first data piece is selected as said first stored data to be stored in said first memory section, and wherein said first storage data is selected as said second storage data to be stored in said second memory section, when said second bitmap image data is selected as said first stored data.

2. The controller/driver according to claim 1, further comprising:

an image processor performing processing on externally received third image data represented in a form other than the bitmap form to develop said second bitmap image data, using said first memory section as a work area.

3. The controller/driver according to claim 2, wherein said third image data is represented in a vector form.

4. A controller/driver comprising:

a control section dividing first bitmap image data representative of $n_1$ grayscale image into first and second data pieces;

an image processor processing on externally received vector data representative of $n_2$ grayscale image to develop second bitmap image data, $n_2$ being smaller than $n_1$;

a first memory section storing first storage data selected out of said first data piece and said second bitmap image data, said first memory section being used as a work area for said image processor to develop said second bitmap image data;

a second memory section storing second storage data selected out of said second data piece and said first storage data received from said first memory section; and a driver section for driving data lines of a display panel in response to said first and second storage data stored in said first and second memory sections, respectively, wherein said second data piece is selected as said second storage data to be stored in said second memory section, when said first data piece is selected as said first stored data to be stored in said first memory section, and wherein said first storage data is selected as said second storage data to be stored in said second memory section, when said second bitmap image data is selected as said first stored data.

5. The controller/driver according to claim 4, wherein said driver section drives said data lines in response to both of said first and second storage data, when said first data piece is selected as said first storage data to be stored in said first memory section, and said second data piece is selected as said second storage data to be stored in said second memory section, and wherein said driver section drives said data lines in response to said second storage data without receiving said first storage data from said first memory section, when said second bitmap image data is transferred from said first memory section to said second memory section, and stored as said second storage data in said second memory section.

6. The controller/driver, according to claim 4, wherein $n_1$ is $2^k$, and $n_2$ is $2^{k/2}$, k being a natural number equal to or more than 2, and wherein a capacity of said first memory section is identical to that of said second memory section.

7. The controller/driver, according to claim 6, wherein said first memory section includes a plurality of first bit lines, wherein said second memory section includes a plurality of second bit lines, a number of said second bit lines being identical to that of said first bit lines, wherein said first bit lines are respectively connected to said second bit lines, and wherein said driver section receives said first storage data stored in said first memory section through said second bit lines.

8. The controller/driver according to claim 4, wherein said driver section includes:

a pixel data generation section developing pixel data representative of a graylevel of each pixel within said display panel from said first storage data and said second storage data, said pixel data generation section comprising first and second latch circuits, a data line driver circuit driving said data lines of said display panel, and wherein, when said first data piece is selected as said first storage data to be stored in said first memory section, and said second data piece is selected as said second storage data to be stored in said second memory section, said first latch circuit latches one of said first and second storage data to develop upper bits of said pixel data, and said second latch circuit latches another of said first and second storage data to develop lower bits of said pixel data, and wherein, when said second bitmap image data is transferred from said first memory section to said second memory section, and stored as said storage data in said second memory section, both of said first and second latch circuits latches said second storage data, and said first latch circuit outputs said second storage data latched therein to develop upper bits of said pixel data, and said second latch circuit outputs said second storage data latched therein to develop lower bits of said pixel data.

9. The controller/driver according to claim 8, wherein first memory section includes a plurality of first bit lines, and second memory section includes a plurality of second bit lines connected to said first bit lines, respectively, wherein said first storage data is transferred from said first bit lines within said first memory section to said driver section through said second bit lines, wherein said first latch circuit comprises a plurality of first latch elements connected to said second bit lines, respectively, wherein said second latch circuit comprises a plurality of second latch elements connected to said second bit lines, respectively, and wherein said first and second latch elements are alternately arranged in a direction orthogonal to said plurality of second bit lines.

10. The controller/driver according to claim 9, wherein said driver section further includes a pixel data latch circuit designed to latch said upper bits of said pixel data from said first latch circuit, and to latch said lower bits of said pixel data from said second latch circuit, wherein said pixel data latch circuit comprises:

third latch elements connected to outputs of said first latch elements of said first latch circuit, respectively, fourth latch elements connected to outputs of said second latch elements of said second latch circuit, respectively, and wherein said third and fourth latches are alternately arranged in said direction.

11. The controller/driver according to claim 4, wherein said driver section further includes output terminals through which said driver section develops drive voltages onto said data lines of said display panel, and wherein said first and second memory sections are arranged in a horizontal direction parallel to a direction in which said output terminals are arranged.

12. The controller/driver according to claim 11, wherein data transfer of said first storage data from said first memory section to said driver section is executed concurrently with data transfer of said second storage data from said second memory section to said driver section.

13. The controller/driver according to claim 11, said driver section further includes:

a horizontal copy circuit;

a memory selector circuit; and a pixel data latch circuit, wherein said horizontal copy circuit transfers said first storage data received from said first memory section to said second memory section, when said second bitmap image data is selected as said first storage data to be stored in said first memory section; and wherein said memory selector circuit outputs one of said first and second storage data as upper bits of pixel data, and another as lower bits of said pixel data, when said first data piece is selected as said first storage data to be stored in said first memory section, and said second data piece is selected as said second storage data to be stored in said second memory section, wherein said memory selector circuit duplicates said second storage data to develop pixel data, when said second bitmap image data stored in said first memory section is transferred to said second memory section to be stored as said second storage data, wherein said pixel data latch circuit latches said pixel data received from said memory selector circuit, and wherein said driver section drives said data lines in response to said pixel data received from said pixel data latch circuit.

14. The controller/driver according to claim 13, wherein said first and second memory sections are monolithically integrated, and constituted of first and second memory cell columns, respectively, and wherein said first and second memory cell columns are alternately arranged in said horizontal direction.

15. The controller/driver according to claim 14, wherein said memory selector circuit includes a plurality of selectors, each having a first input connected to associated one of said first memory cell columns, and a second input connected to associated one of said second memory cell columns, wherein said pixel data latch circuit includes:

a plurality of fifth latch elements connected to said first memory cell columns, respectively, and a plurality of sixth latch elements connected to said second memory cell columns, respectively, and wherein said fifth and sixth latch elements are alternately arranged in said horizontal direction.

16. A method for operating a controller/driver including first and second memory sections and a driver section, said method comprising:

dividing first bitmap image data representative of $n_1$ grayscale image into first and second data pieces, $n_1$ being a natural number;

storing said first and second data pieces into said first and second memory sections, respectively, transferring said first and second data pieces from said first and second memory sections, respectively, to said driver section;

said driver section driving data lines of a display panel in response to said first and second data pieces;

storing second bitmap image data representative of $n_2$ grayscale image into said first memory section, $n_2$ being a natural number smaller than $n_1$;

transferring said second bitmap image data from said first memory section to said second memory section;

transferring said second bitmap image data from said second memory section to said driver section; and said driver section driving said data lines of said display panel in response to said second bitmap image data received from said second memory section.

17. A method for operating a controller/driver including an image processor, first and second memory sections, and a driver section, said method comprising:

dividing first bitmap image data representative of $n_1$ grayscale image into first and second data pieces, $n_1$ being a natural number;

storing said first and second data pieces into said first and second memory sections, respectively, transferring said first and second data pieces from said first and second memory sections, respectively, to said driver section;

said driver section driving data lines of a display panel in response to said first and second data pieces;

said image processor converting vector data representative of $n_2$ grayscale image into second bitmap data using said first memory section as a work area, to develop said second bitmap data onto said first memory section;

transferring said second bitmap image data from said first memory section to said second memory section;

transferring said second bitmap image data from said second memory section to said driver section; and said driver section driving said data lines of said display panel in response to said second bitmap image data received from said second memory section.

18. A controller/driver comprising:

a display memory including first and second memory sections;

a memory controller circuit configured to, when being provided with image data represented in a first form, divide said image data into first and second image data, and to, when being provided with image data represented in a second form, stores third image data generated from said image data represented in said second form into both of said first and second memory sections; and a driver section driving data lines within a display panel in response to said image data stored in said first and second memory sections.

19. The controller/driver according to claim 18, further comprising:

an image processor performing processing on said image data represented in said second form using one of said first and second memory sections as a work area.

20. The controller/driver according to claim 18, wherein said first form is a bitmap form, and said second form is a vector form.

* * * * *